US010752401B2

(12) United States Patent
Zhang

(10) Patent No.: US 10,752,401 B2
(45) Date of Patent: Aug. 25, 2020

(54) LIFTING HANDLE

(71) Applicant: BETTER ALLYING DESIGN CO., LTD., Kaohsiung (TW)

(72) Inventor: Shao-Wen Zhang, Kaohsiung (TW)

(73) Assignee: BETTER ALLYING DESIGN CO., LTD., Kaohsiung (TW)

( * ) Notice: Subject to any disclaimer, the term of this patent is extended or adjusted under 35 U.S.C. 154(b) by 645 days.

(21) Appl. No.: 15/769,888

(22) PCT Filed: Aug. 8, 2014

(86) PCT No.: PCT/CN2014/083983
§ 371 (c)(1),
(2) Date: Apr. 20, 2018

(87) PCT Pub. No.: WO2015/021883
PCT Pub. Date: Feb. 19, 2015

(65) Prior Publication Data

US 2018/0312298 A1 Nov. 1, 2018

(30) Foreign Application Priority Data

Aug. 14, 2013 (CN) ..... 2013 1 0353658
Aug. 7, 2014 (CN) ..... 2014 1 0386862

(51) Int. Cl.
*B65D 23/10* (2006.01)
*B65D 25/28* (2006.01)
(Continued)

(52) U.S. Cl.
CPC ..... *B65D 23/108* (2013.01); *B65D 25/2876* (2013.01); *B65D 25/32* (2013.01); *B65D 71/48* (2013.01)

(58) Field of Classification Search
CPC ..... A47G 23/0216; B65D 23/104; B65D 23/108; B65D 25/2876; B65D 25/32; B65D 71/48; B65D 71/504
(Continued)

(56) References Cited

U.S. PATENT DOCUMENTS 1,982,276 A * 11/1934 West ..... B65D 23/104 294/27.1
2,194,898 A 3/1940 Hanford
(Continued)

FOREIGN PATENT DOCUMENTS

CN 201095441 Y 8/2008
CN 202987697 U 6/2013
(Continued)

*Primary Examiner* — Dean J Kramer
(74) *Attorney, Agent, or Firm* — Birch, Stewart, Kolasch & Birch, LLP

(57) ABSTRACT

A lifting handle (1, 2) for enhancing the convenience of carrying containers. The lifting handle (1, 2) comprises: a base board (11, 21), the base board (11, 21) comprising two end edges (111, 211) and two side edges (112, 212); the two end edges (111, 211) form the two ends of the base board (11, 21), and the two ends of the two side edges (112, 212) respectively connect to the two end edges (111, 211); the base board (11, 21) is provided with at least one cutting part (12, 22), and the at least one cutting part (12, 22) extending from the position of one end edge (111, 211) near the base board (11, 21) to the position of the other end edge (111, 211) near the base board (11, 21), such that the base board (11, 21) forms two carrying parts (13, 23) and a lifting handle part (14, 24).

18 Claims, 26 Drawing Sheets

(51) Int. Cl.
*B65D 71/48* (2006.01)
*B65D 25/32* (2006.01)

(58) Field of Classification Search
USPC ..... 294/27.1, 31.2, 87.2, 149, 165; 229/117.09, 117.19, 117.23
See application file for complete search history.

(56) References Cited

U.S. PATENT DOCUMENTS 2,822,208 A * 2/1958 Then ..... B65D 71/44 294/87.2
3,269,530 A * 8/1966 Wanderer ..... B65D 71/504 206/150
3,589,764 A * 6/1971 Cunningham ..... B65D 25/2876 294/31.2
3,594,891 A 7/1971 Cunningham
3,726,558 A * 4/1973 Klygis ..... B65D 71/504 294/87.2
4,582,215 A * 4/1986 Barrash ..... B65D 23/108 206/150
4,799,723 A * 1/1989 Mahaffy ..... B65D 71/504 206/150
5,290,083 A * 3/1994 Rissley ..... B65D 71/504 206/150
5,467,915 A * 11/1995 Mattson ..... A45C 13/26 215/396
6,273,333 B1 * 8/2001 Ward ..... A47G 23/0216 220/738
6,874,620 B2 * 4/2005 Mattson ..... B65D 71/504 206/148
7,819,277 B2 * 10/2010 Hanson ..... A45C 3/00 220/62
2007/0045389 A1 3/2007 Kalberer

FOREIGN PATENT DOCUMENTS

| | | | |
|---|---|---|---|
| CN | 202987842 | U | 6/2013 |
| DE | 102007016202 | A1 | 10/2008 |
| JP | 36-22211 | | 11/1961 |
| JP | S4928869 | Y1 | 8/1974 |
| JP | H076136 | U | 1/1995 |
| JP | H0958652 | A | 3/1997 |
| WO | WO0069736 | | 11/2000 |

* cited by examiner

LIFTING HANDLE

BACKGROUND OF THE INVENTION

Technical Field

The invention relates to a lifting handle, in particular to a lifting handle which can be combined with a container so that a user can carry the container conveniently.

Background Technique

Various types of food sold on the market are contained in containers. However, the container could be used for containing high-temperature, room-temperature or low-temperature contents. If the container is filled with the high-temperature content, an accident may happen and causes the user to get burned when the user wants to hold the container and directly contacts the outer surface of the container. In contrast, when the container is filled with the low-temperature content, the container is easily to make the moisture in the air condense into droplets and adhere to the outer surface of the container. When the user holds the container and directly contacts the outer surface of the container, the droplets adhered to the outer surface of the container may wet the user's hands, and thereby brings inconveniences to the user.

In order to facilitate users holding and carrying containers filled with high-temperature or low-temperature contents, merchants conventionally place the container in a plastic bag or a paper bag to be carried by a user. However, due to the rising awareness of environmental protection in recent years, the desire of using plastic bags for consumers and merchants is gradually reduced. Although the recycled paper bags can solve people's concerns about the environmental issues, the cost of the recycled paper bag is too high. Furthermore, when the containers is filled with low-temperature content, the paper bag is often cracked by soaking, which may easily result in many inconveniences when the paper bag is used to carry the container.

DISCLOSURE OF THE INVENTION

Technical Problems

Therefore, a problem that manufacturers are eager to solve is to provide a lifting handle that facilitate the users carrying a container containing high-temperature or low-temperature contents with a low cost in the condition that people generally advocate reducing the use of plastic bags.

Solution to Problems

Technical Solution

An objective of the present invention is to provide a lifting handle including a base plate, with at least one cut portion arranged on the base plate. Therefore, the base plate can form two supporting portion and a handling portion. The lifting handle can be combined with a container, so that the user can carry the container via the lifting handle, which improves the convenience in carrying the container.

Another objective of the present invention is to provide a lifting handle, wherein the base plate is in a flat form before coupling with the container, to attain the effect of reducing the cost of use of the lifting handle.

In order to achieve the above objectives, the technical means used in the present invention include:

A base plate with two edges and two lateral sides, with the two edges formed at two ends of the base plate respectively, and with each of the lateral sides having two ends connected to the two edges respectively. Two cut portions are spaced and arranged on the base plate, with the two cut portions extending from a position adjacent to one of the two edges of the base plate towards a position adjacent to another one of the two edges of the base plate. The two cut portions are respectively spaced from the two lateral sides.

The lifting handle described as above, wherein the base plate has a first direction and a second direction, which are perpendicular to each other. The two edges are respectively formed on the two ends of the base plate in the first direction, and the two lateral sides are respectively formed on two sides of the base plate in the second direction. The two cut portions are respectively spaced from the two lateral sides in the second direction.

The lifting handle described as above, wherein a supporting portion is formed between each of the lateral sides and the cut portion adjacent to the lateral side, and a handling portion is formed between the two cut portions.

The lifting handle described as above, wherein the lifting handle includes a first state, the base plate is in a flat form in the first state. The two supporting portions can be pulled toward two sides along the second direction, to change the lifting handle from the first state to a second state. A supporting edge is formed at a side of the supporting portion faced to the adjacent cut portion, and an opening is formed between the two supporting portions.

The lifting handle described as above, wherein the lifting handle is provided to be combined with a container. The container includes an expanding portion located between the two supporting portions and the handling portion, with the two supporting portions abutting the outer surface of the container, and with the supporting edges of two supporting portions respectively abutting the expanding portion.

The lifting handle described as above, wherein the ends of the cut portion respectively forms an extending portion, with the extending portion extending from the cut portion toward the adjacent lateral side along the first direction, so that a distance between the extending portions of the two cut portions is increasing from the two cut portions toward the adjacent edges.

The lifting handle described as above, wherein the two edges of the base plate respectively connects to a reinforcing portion, wherein the reinforcing portion is coupled with the two supporting portions and the handling portion at the same time.

The lifting handle described as above, wherein the base plate is made of paper materials. In the second state, a crease is formed at a position adjacent to the two edges of the base plate, respectively. The two ends of the cut portion respectively forms an extending portion extended from the cut portion toward a center of the base plate along the first direction, so that a distance of the extending portion of the two cut portions is increased from the two cut portions toward the adjacent edges.

A lifting handle includes a base plate with two edges and two lateral sides, with the two edges formed at two ends of the base plate, respectively, and with each of the lateral sides having two ends connected to the two edges respectively. A cut portion is arranged on the base plate, with the cut portion extending from a position adjacent to one of the end edges of the base plate towards a position adjacent to the other one of the end edges of the base plate. One of the two edges of the base plate is coupled with a handling portion.

The lifting handle described as above, wherein the base plate has a first direction and a second direction, which are perpendicular to each other. The two edges are respectively formed at the two ends of the base plate in the first direction, and the two lateral sides are respectively formed on two sides of the base plate in the second direction. The cut portion extends along the first direction, with two sides of the cut portion respectively forms a supporting portion.

The lifting handle described as above, wherein the lifting handle includes a first state. In the first state, the base plate is in a flat form. The handling portion can be coupled with the other one of the end edges of the base plate, so that the base plate forms an annular structure. The two supporting portions can be pulled toward two sides along the second direction, to change the lifting handle from the first state to a second state. A supporting edge is formed at a side of the supporting portion faced to the adjacent cut portion, and an opening is formed between the two supporting portions.

The lifting handle described as above, wherein the lifting handle is configured to be combined with a container. The container includes an expanding portion located between the two supporting portions and the handling portion, with the two supporting portions abutting the outer surface of the container, and with the supporting edges of two supporting portions respectively abutting the expanding portion.

The lifting handle described as above, wherein a first coupling portion is arranged at one of the edges of the handling portion away from the base plate, wherein a second coupling portion is connected to another of the end edges of the base plate, wherein the first coupling portion and the second coupling portion can be combined with each other to couple the handling portion to the other of the end edges of the base plate, forming the base plate as the annular structure as described.

The lifting handle described as above, wherein each of two ends of the cut portion is provided with a guiding hole.

The lifting handle described as above, wherein the two ends of the cut portion are respectively connected to two pre-folded lines respectively extending from the cut portion toward the two lateral sides in the first direction. In the second state, the pre-folded lines permit the supporting portion to form two creases at positions respectively adjacent to the two edges of the base plate.

The lifting handle described as above, wherein the two edges of the base plate are respectively coupled with a first handling portion and a second handling portion, wherein the first handling portion and the second handling portion are respectively arranged with a through-hole The first handling portion and the second handling portion are aligned with each other to form the base plate as the annular structure.

The lifting handle described as above, wherein an engaging portion is arranged on the first handling portion or the second handling portion, and an edge of the through-hole of the second handling portion is engaged with a closure plate The closure plate is able to extend through the through-hole of the first handling portion. Two slits are arranged on the closure plate. The two slits respectively extend through the closure plate.

The lifting handle described as above, wherein an isolation portion is arranged on the base plate. Two cut portions are respectively arranged at two sides of the isolation portion of the base plate in the second direction. Two sides of the each of the two cut portions respectively form a supporting portion in the second direction.

The lifting handle described above, wherein, comprises another base plate. Two edges of the each base plate respectively couple with a third handling portion and a fourth handling portion. An insertion slit is arranged on the third handling portion. The insertion slit extends in the second direction and extends through the third handling portion. A through-hole is arranged on the fourth handling portion. The fourth handling portions respectively coupled with the two base plates connect with each other. The connecting part of the two fourth handling portions forms a central line. The two fourth handling portions can be folded along the central line and can be inserted into the insertion slits of the two third handling portions, respectively. The through-holes of the two fourth handling portions are aligned with each other, so that the two base plates jointly form the annular structure.

The lifting handle described as above, wherein two pre-folded lines are respectively arranged on two sides of the handling portion in the second direction. The two pre-folded lines form arc shapes having openings respectively facing two sides of the handling portion, respectively. A stripping line is arranged between the two pre-folded lines of the handling portion.

With the above structures, the lifting handle according to the present invention has a first state. A user can pull the two supporting portion toward two sides to change the lifting handle from the first state to a second state, forming an opening between the two supporting portion. Thus, a container can extend through the opening. An expanding part of the container can be positioned between the two supporting portions and the handling portion, so that the two supporting portions can respectively abut the expanding portion, so that the lifting handle can be combined with the container. Accordingly, the user can carry the container via the lifting handle by simply holding the handling portion without touching the outer surface of the container, improving the convenience in carrying the container. Furthermore, in the first state, the base plate is in a flat shape. Thus, the lifting handle has the advantages such as easy storage, smaller storage space and the like, and can achieve the advantage of reducing the cost of use of the lifting handle.

BRIEF DESCRIPTION OF THE ACCOMPANYING DRAWINGS

Description of the Accompanying Drawings

Figure 9:
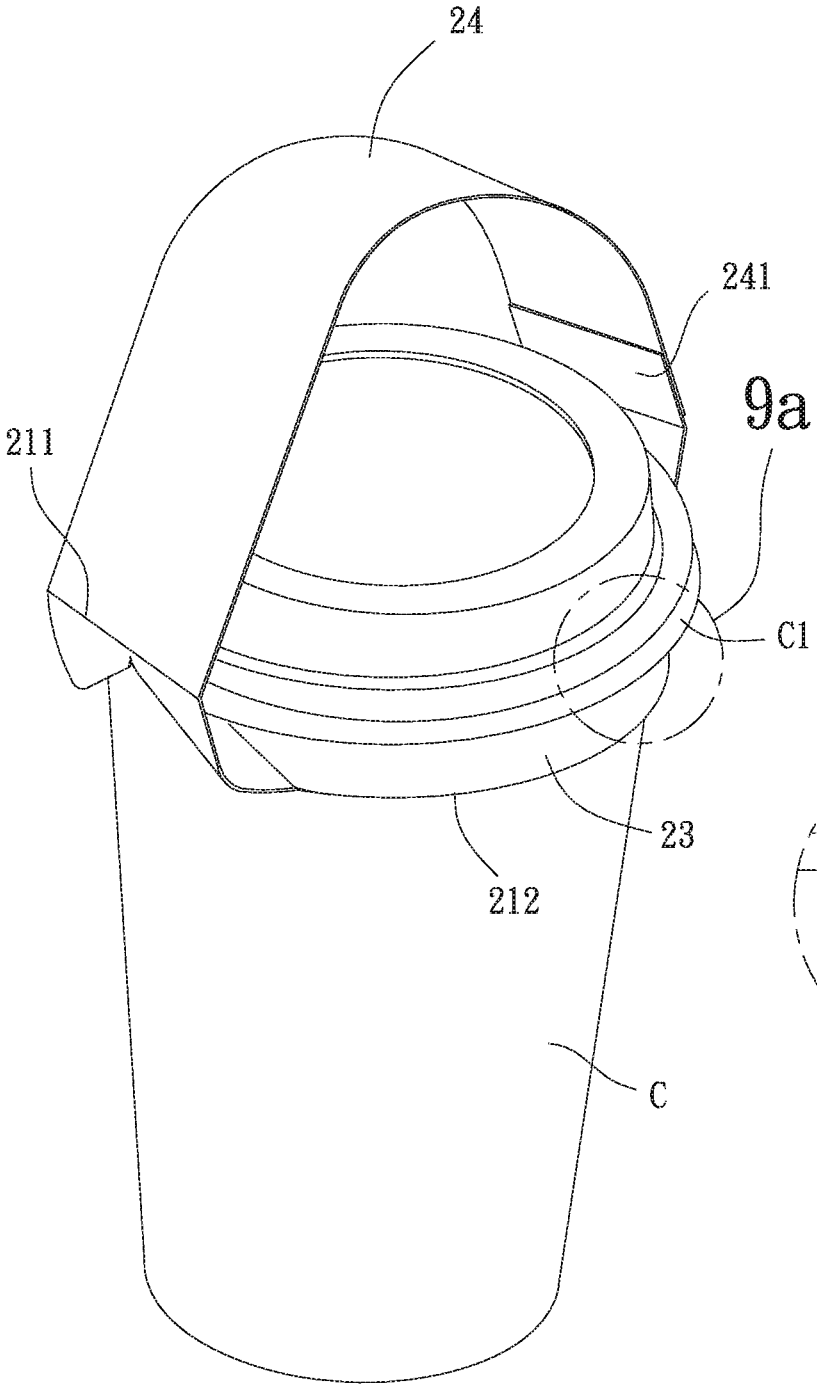
FIG. 9 shows a use of the third embodiment in connection with a container according to the present invention.
Figure 9A:
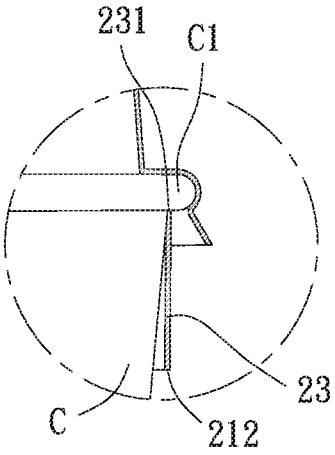

FIG. 9*a* is a partial, enlarged view of the third embodiment in connection with a container according to the present invention.

Figure 10:
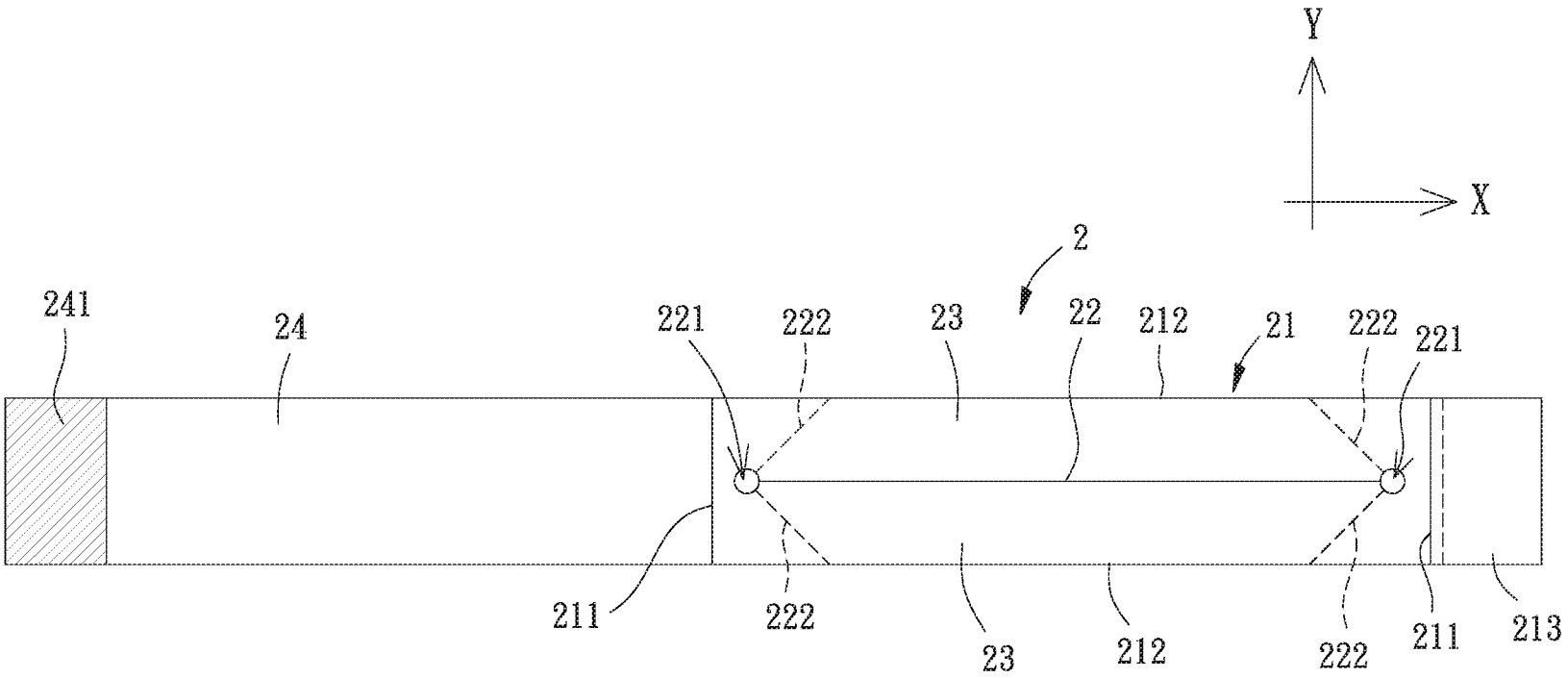

FIG. 10 is a schematic view of an appearance of a fourth embodiment according to the present invention.

Figure 11:
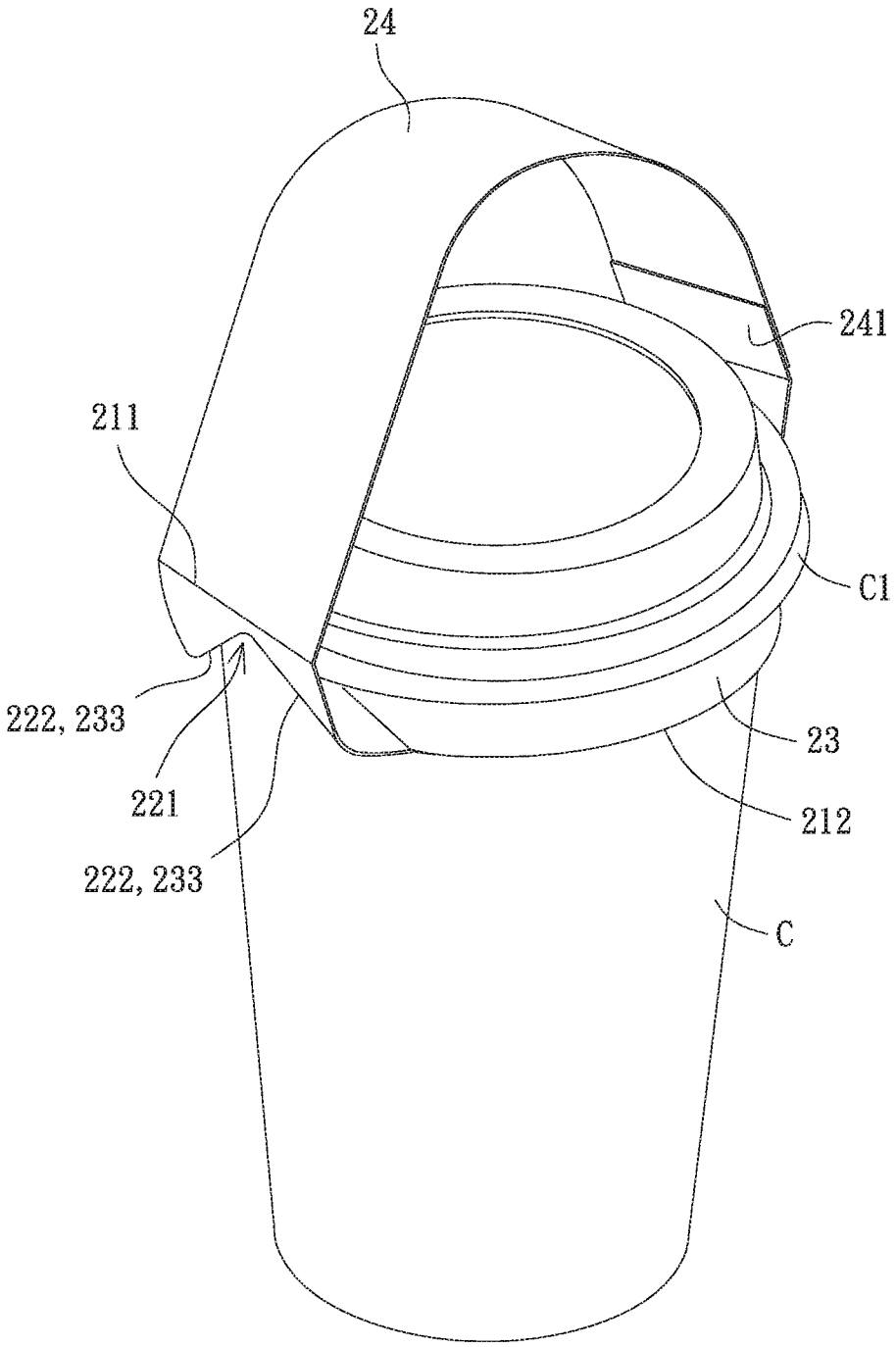

FIG. 11 shows a use of the fourth embodiment in connection with a container according to the present invention.

Figure 12:
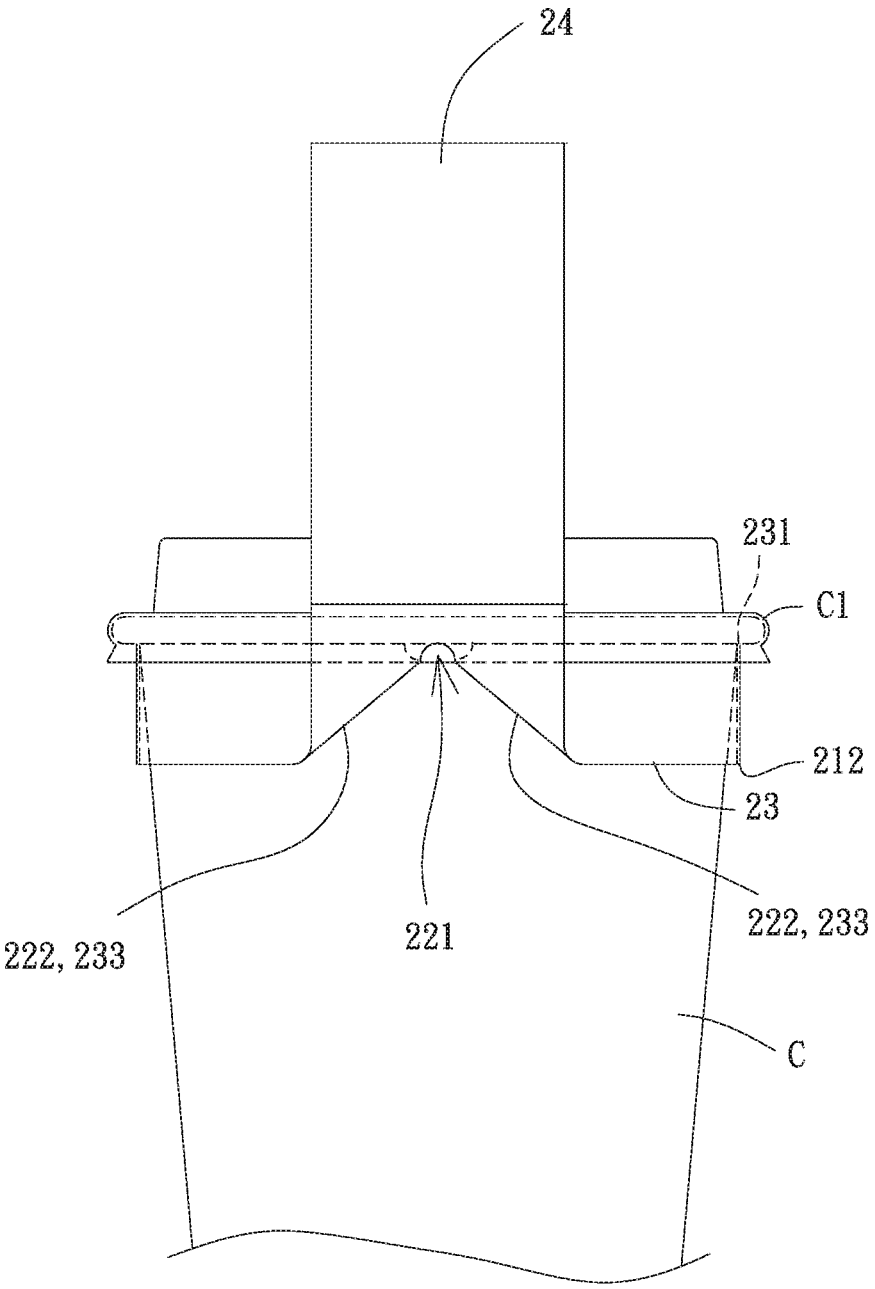

FIG. 12 is a partial, enlarged view of the third embodiment in connection with a container according to the present invention.

Figure 13:
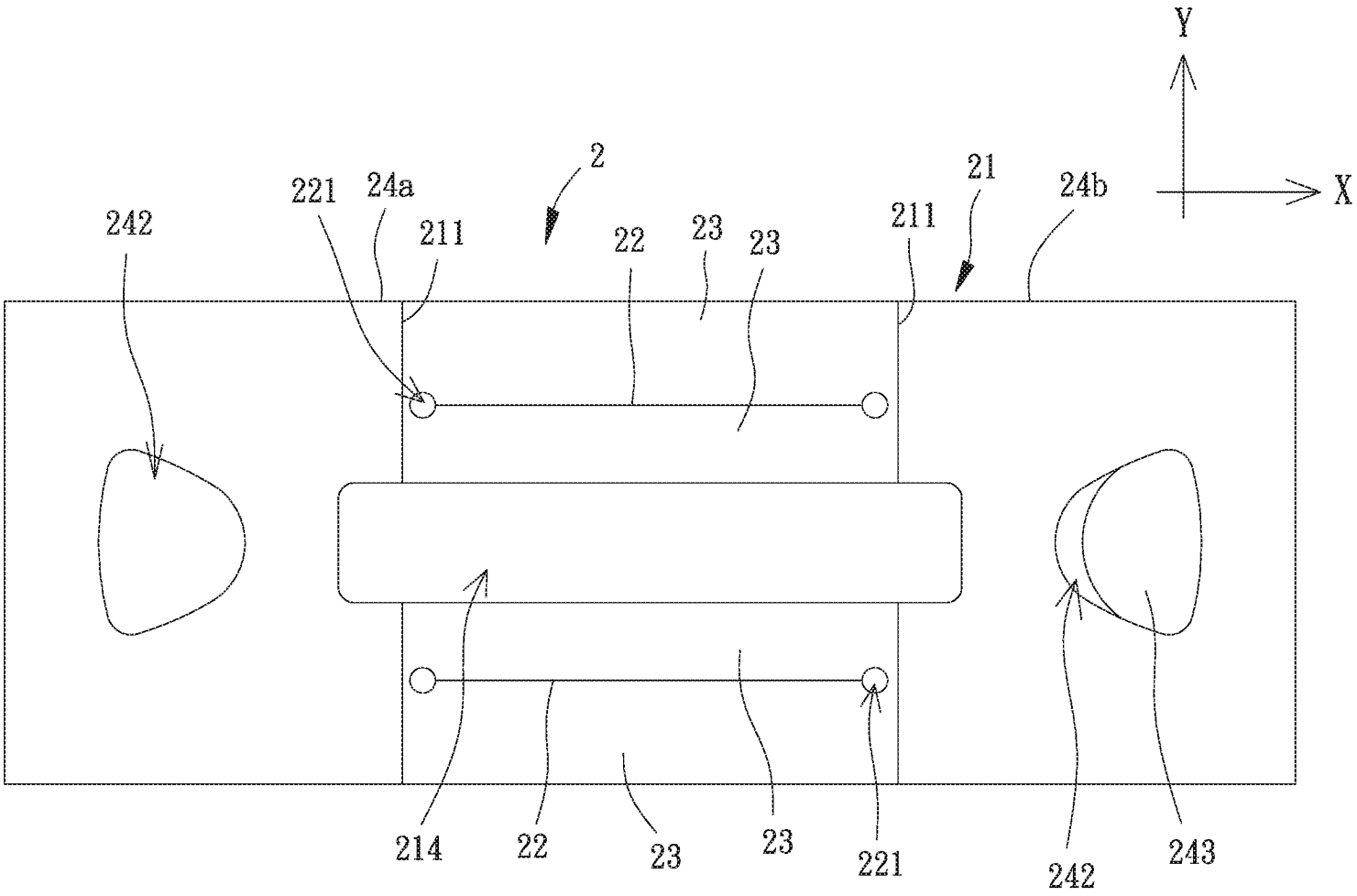

FIG. 13 is a schematic view of an appearance of a fifth embodiment according to the present invention.

Figure 14:
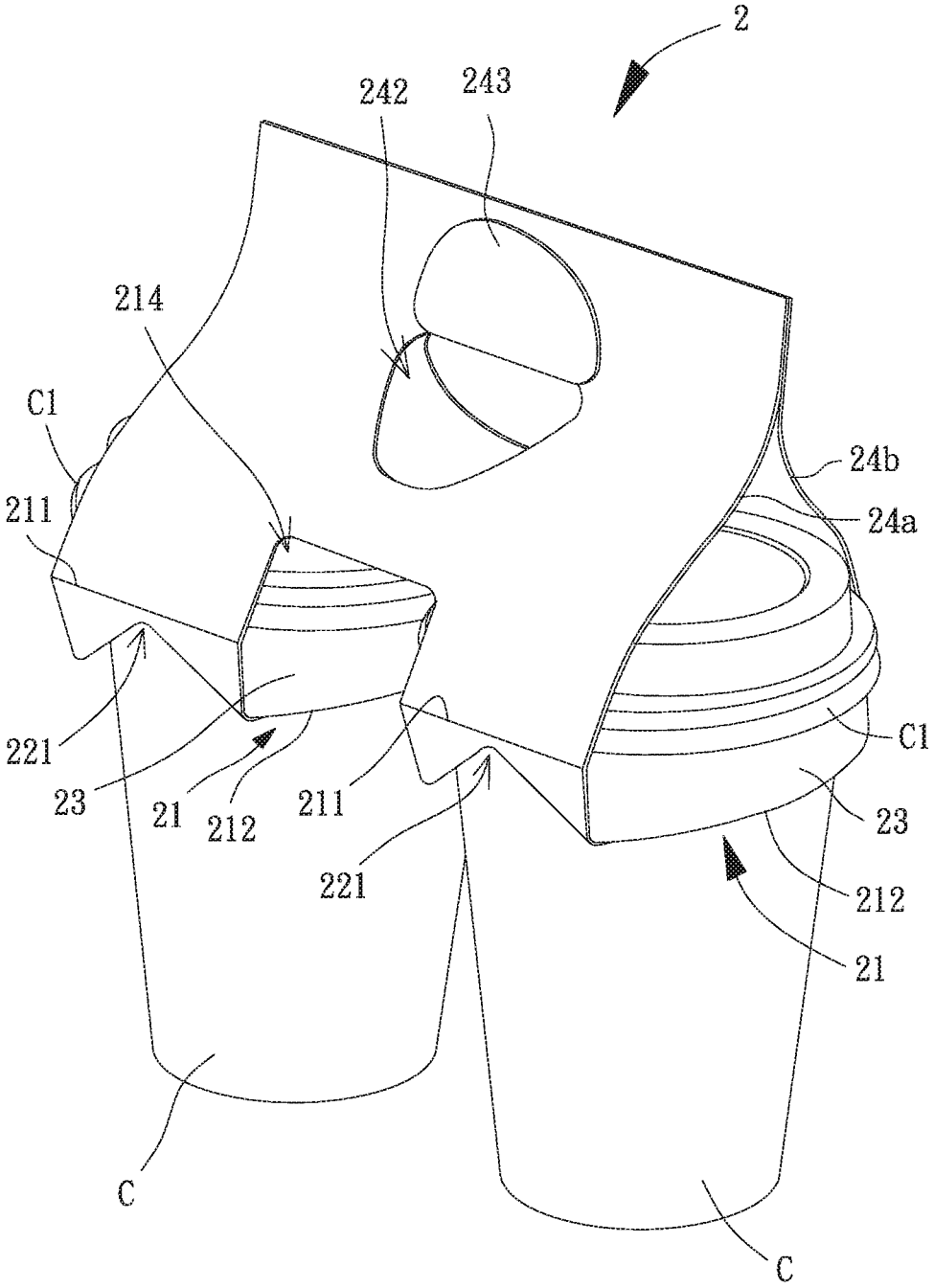

FIG. 14 shows a use of the fifth embodiment in connection with a plurality of containers according to the present invention.

Figure 15:
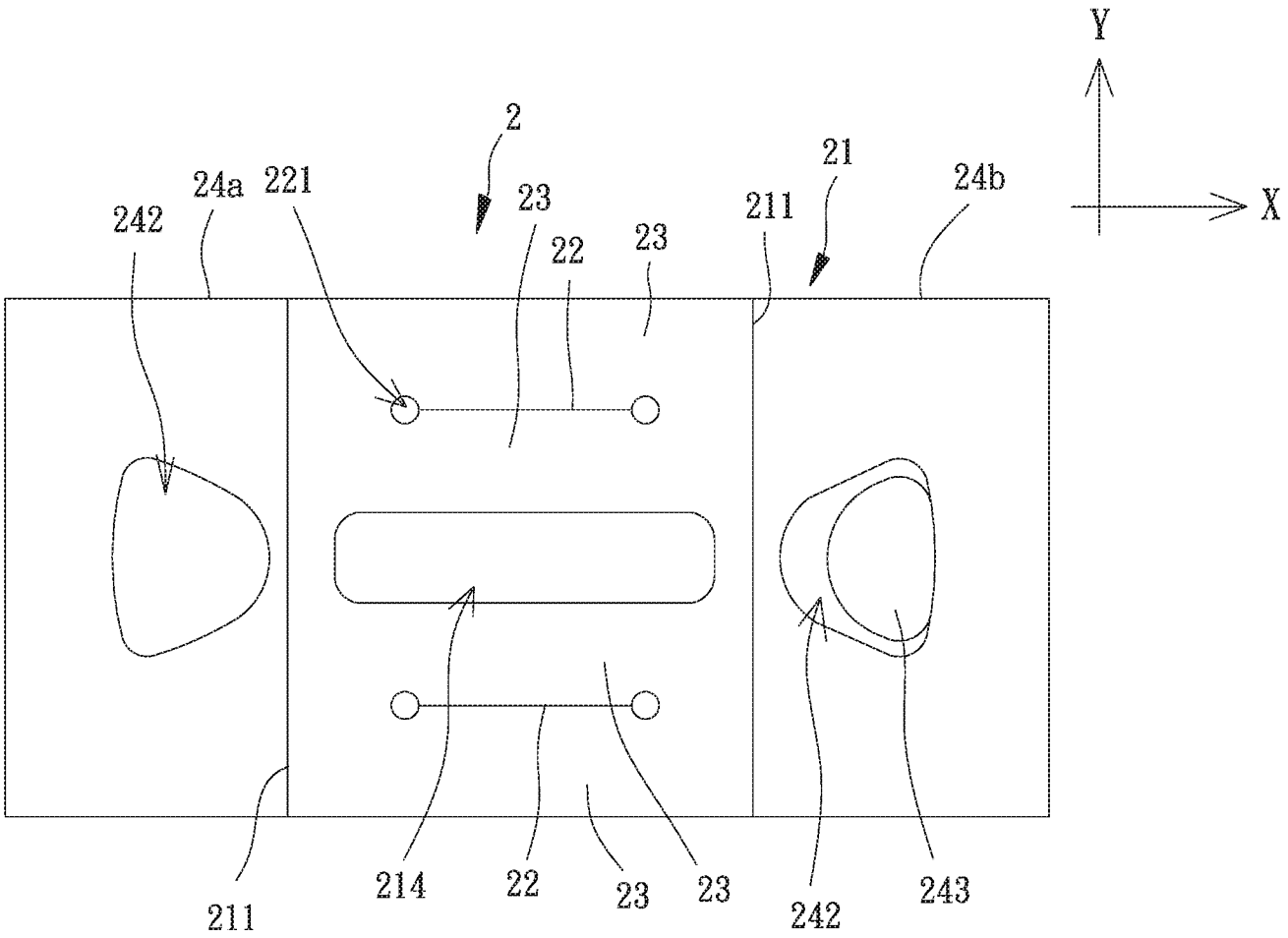

FIG. 15 is a schematic view of an appearance of another implementation of the fifth embodiment according to the present invention.

Figure 16:
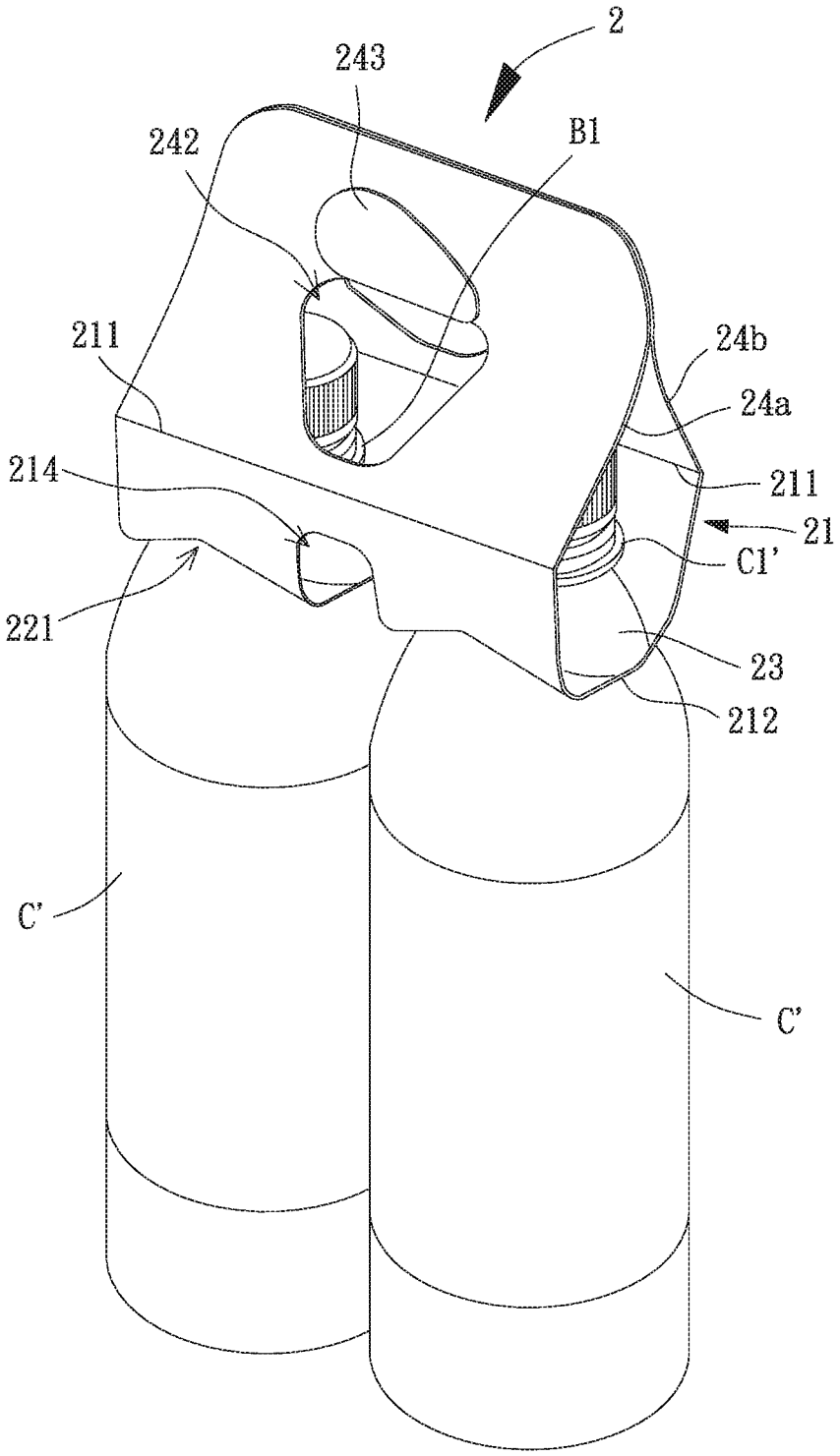

FIG. 16 shows a use of the fifth embodiment in connection with a plurality of containers according to the present invention.

Figure 17:
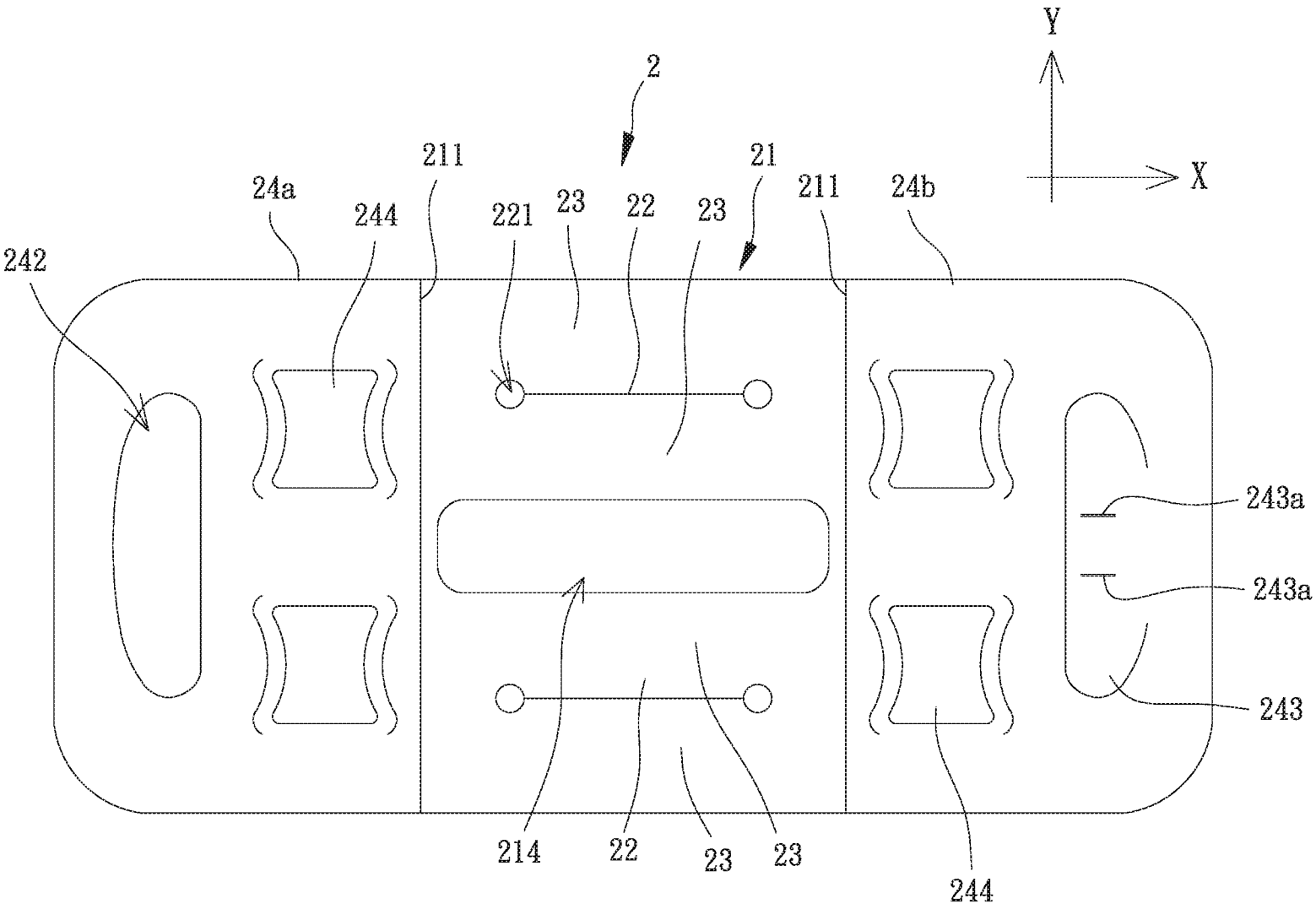

FIG. 17 is a schematic view of an appearance of a sixth embodiment according to the present invention.

Figure 18:
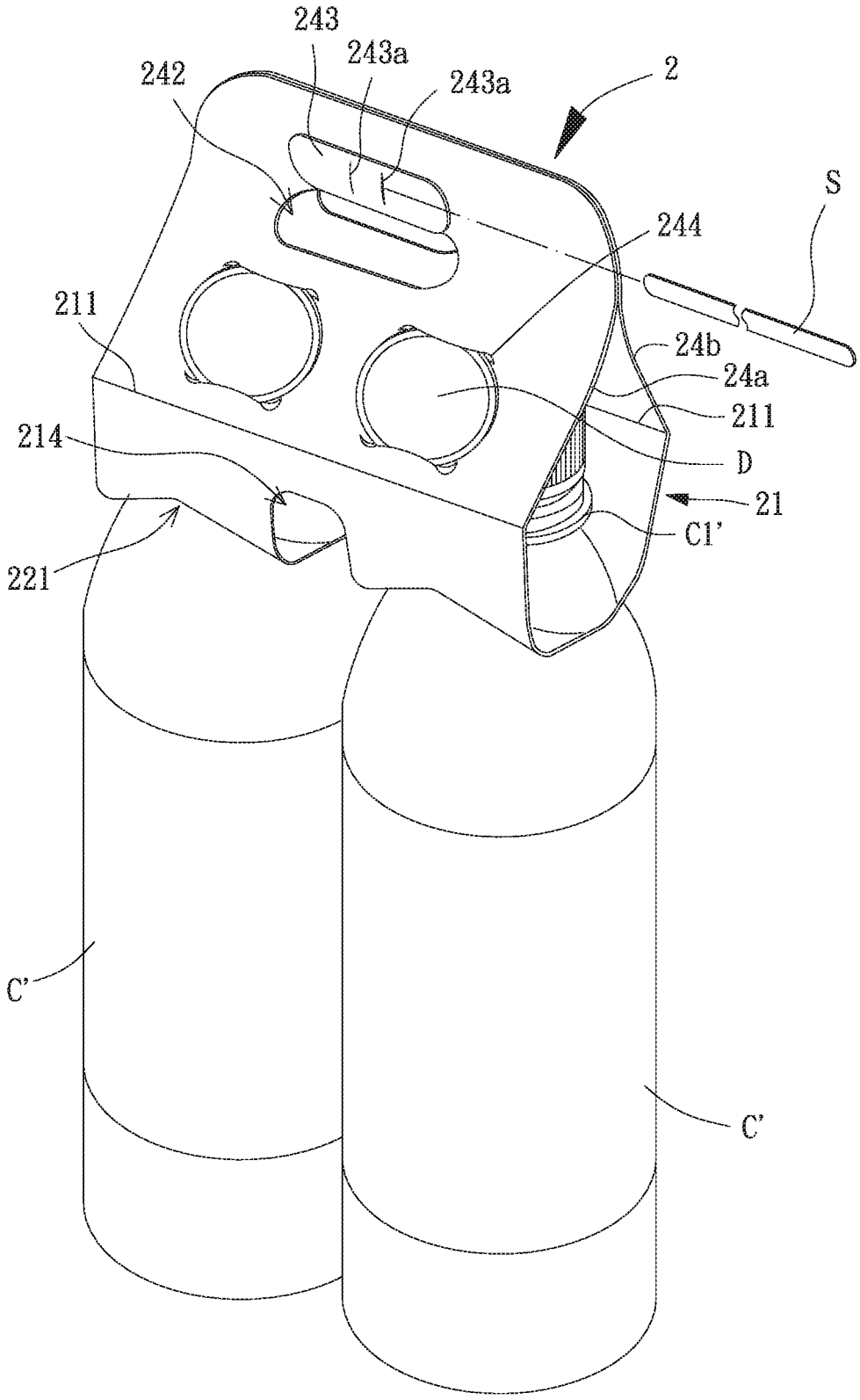

FIG. 18 shows a use of the sixth embodiment in connection with a plurality of containers according to the present invention.

Figure 19:
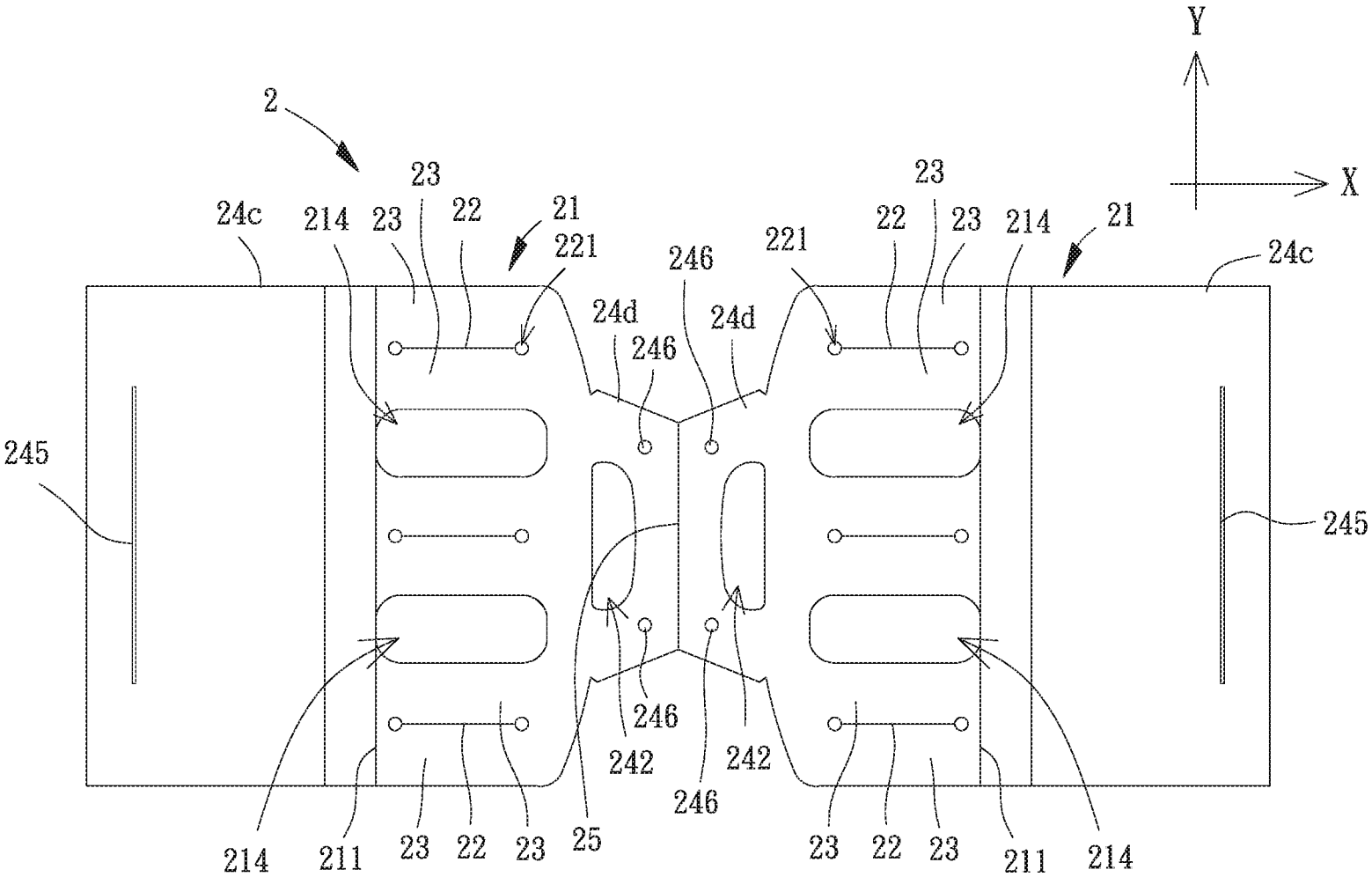

FIG. 19 is a schematic view of an appearance of a seventh embodiment according to the present invention.

Figure 20:
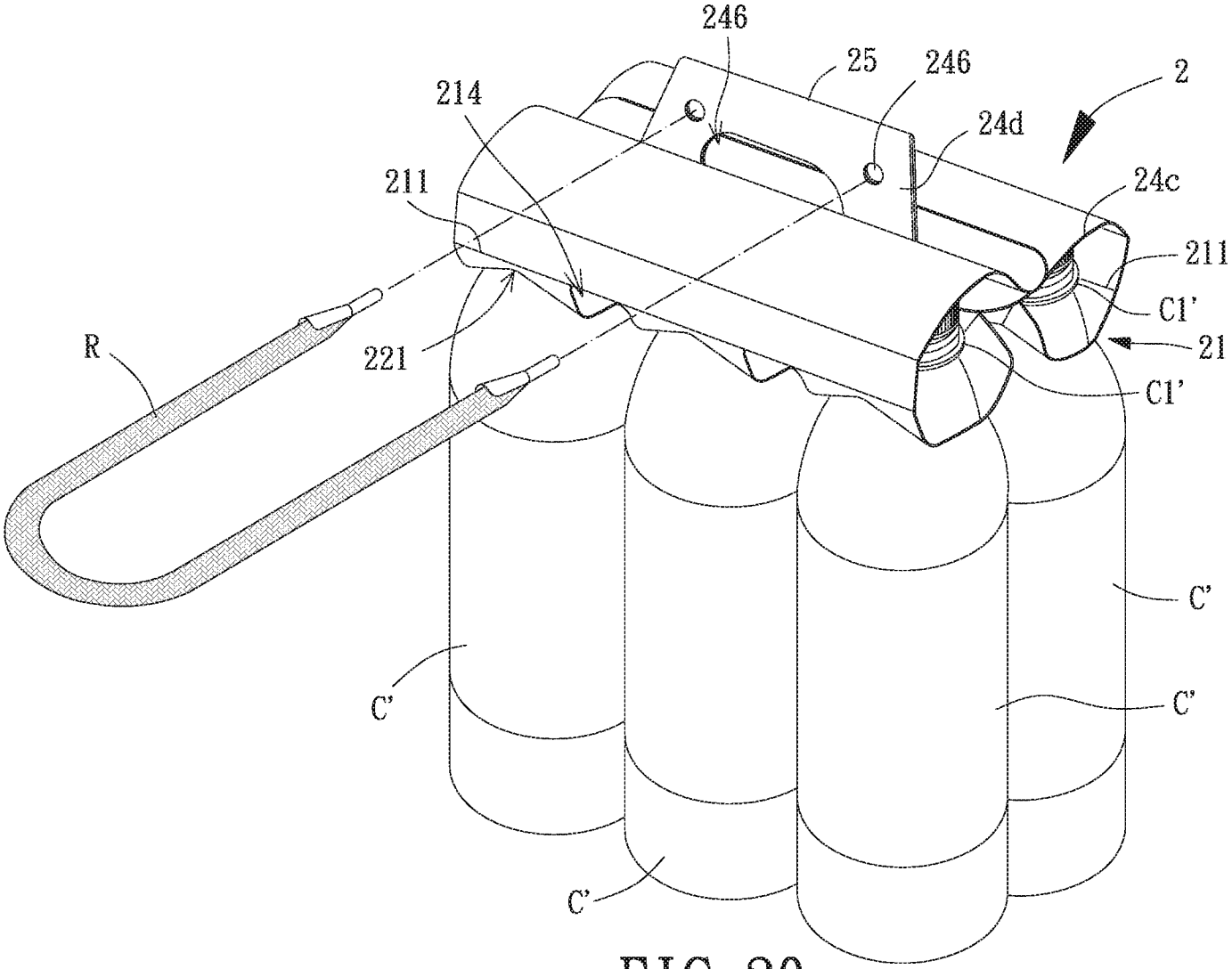

FIG. 20 shows a use of the seventh embodiment in connection with a plurality of containers according to the present invention.

Figure 21:
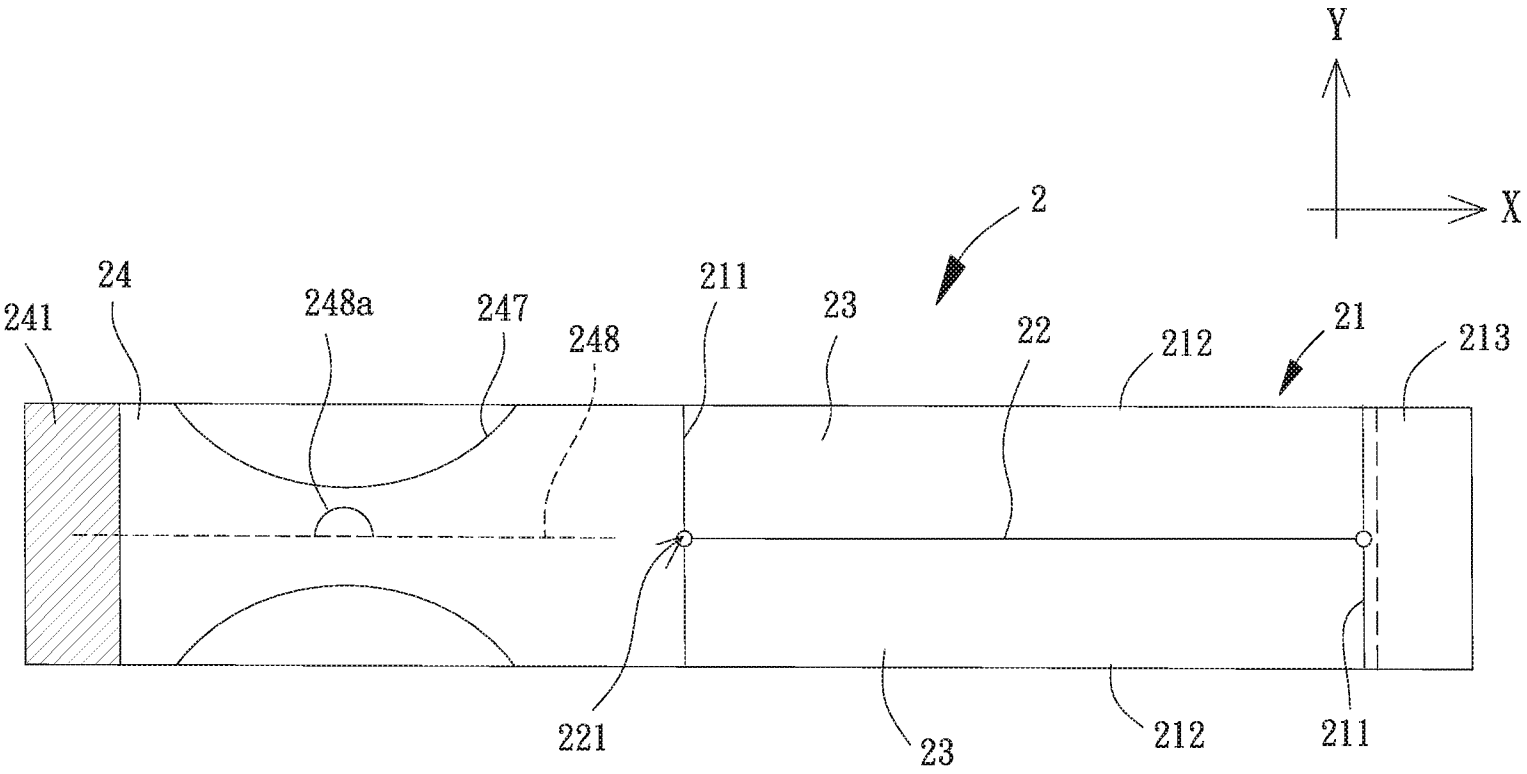

FIG. 21 is a schematic view of an appearance of an eighth embodiment according to the present invention.

Figure 22A:
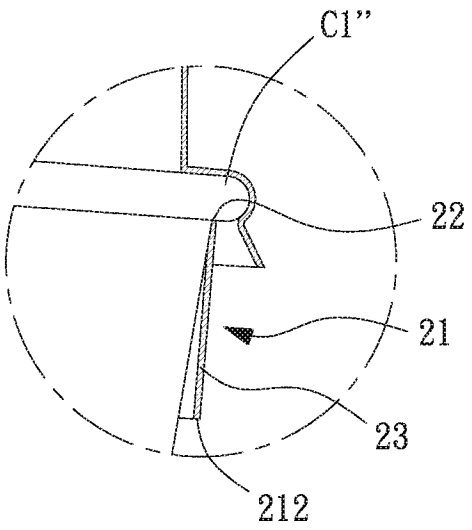
Figure 22:
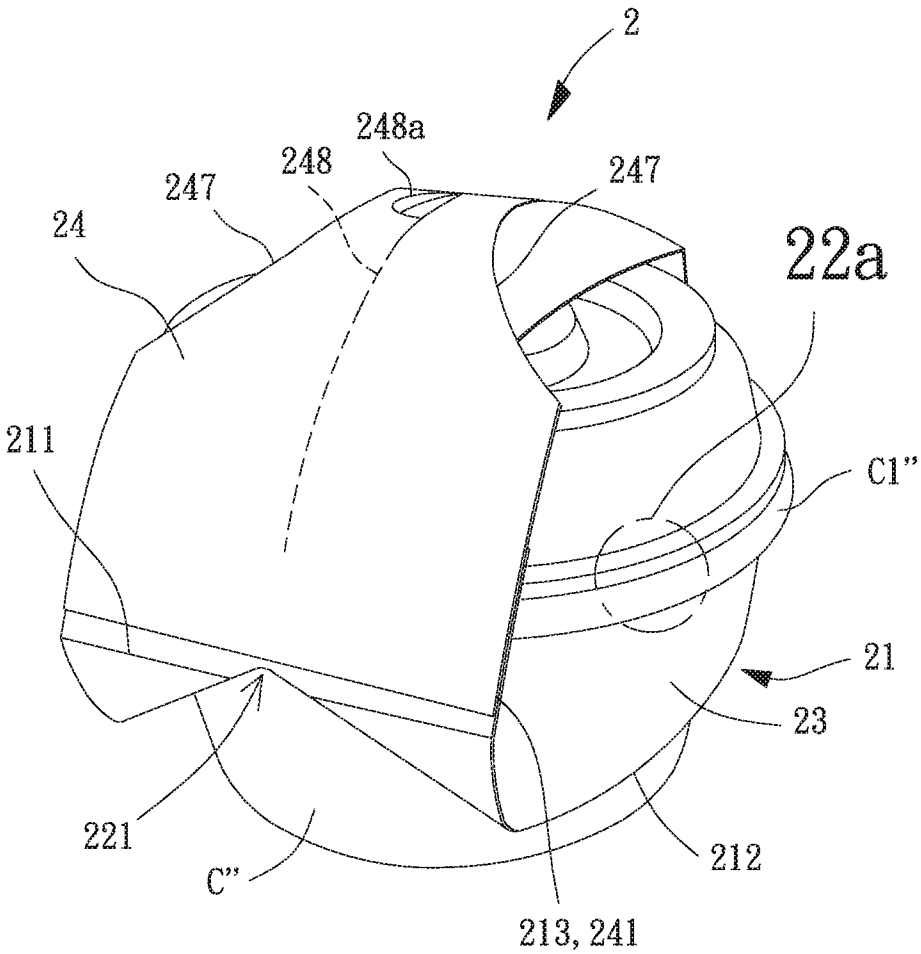

FIG. 22 shows a use of the eighth embodiment in connection with a bowl-shaped container according to the present invention.

FIG. 22*a* shows a partial, enlarged view of the eighth embodiment in connection with a bowl-shaped container according to the present invention.

Figure 23:
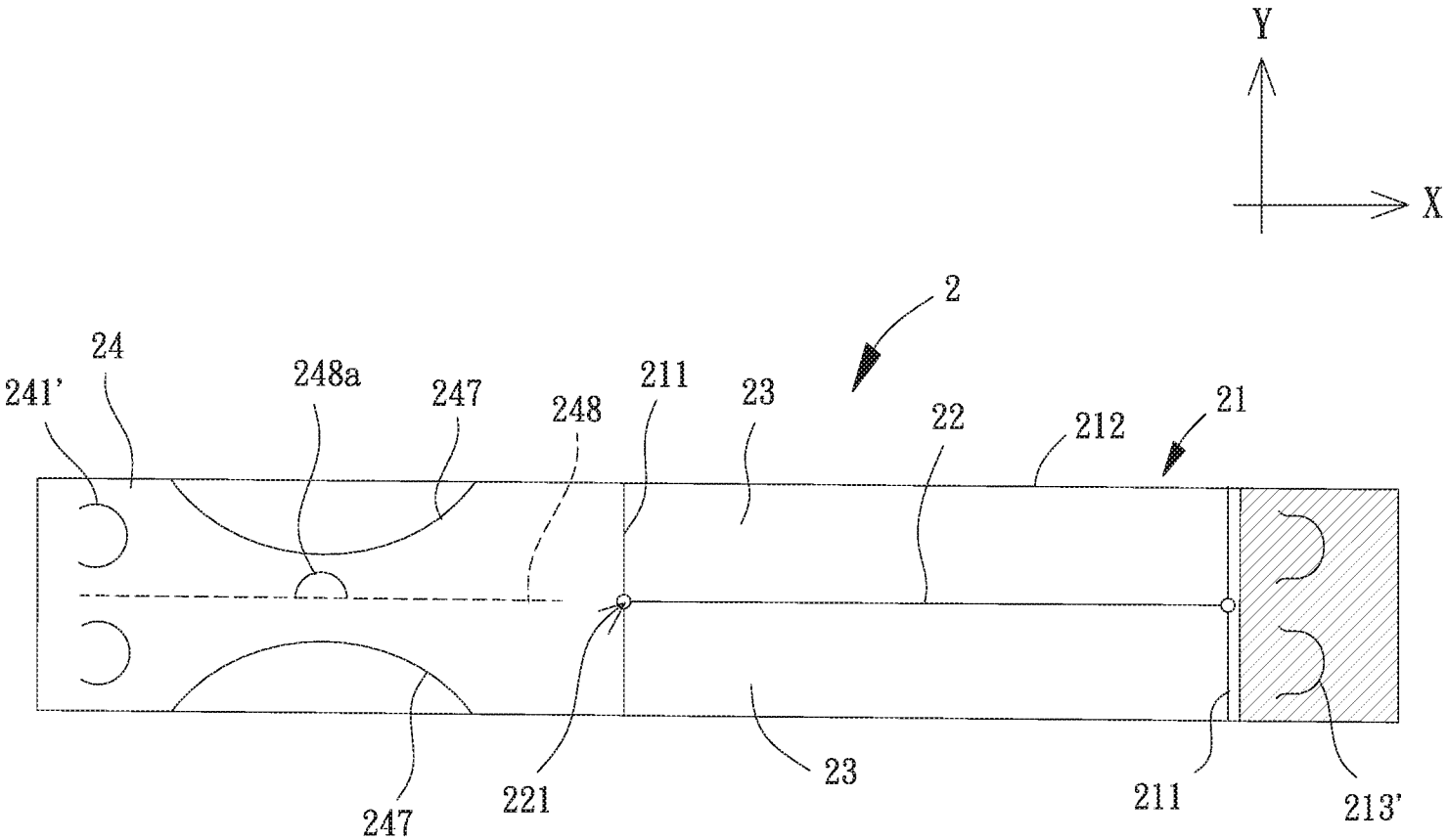

FIG. 23 is a schematic view of an appearance of the eighth embodiment having of a first coupling portion and a second coupling portion in the form of buckling pieces arranged in a same direction according to the present invention.

Figure 24:
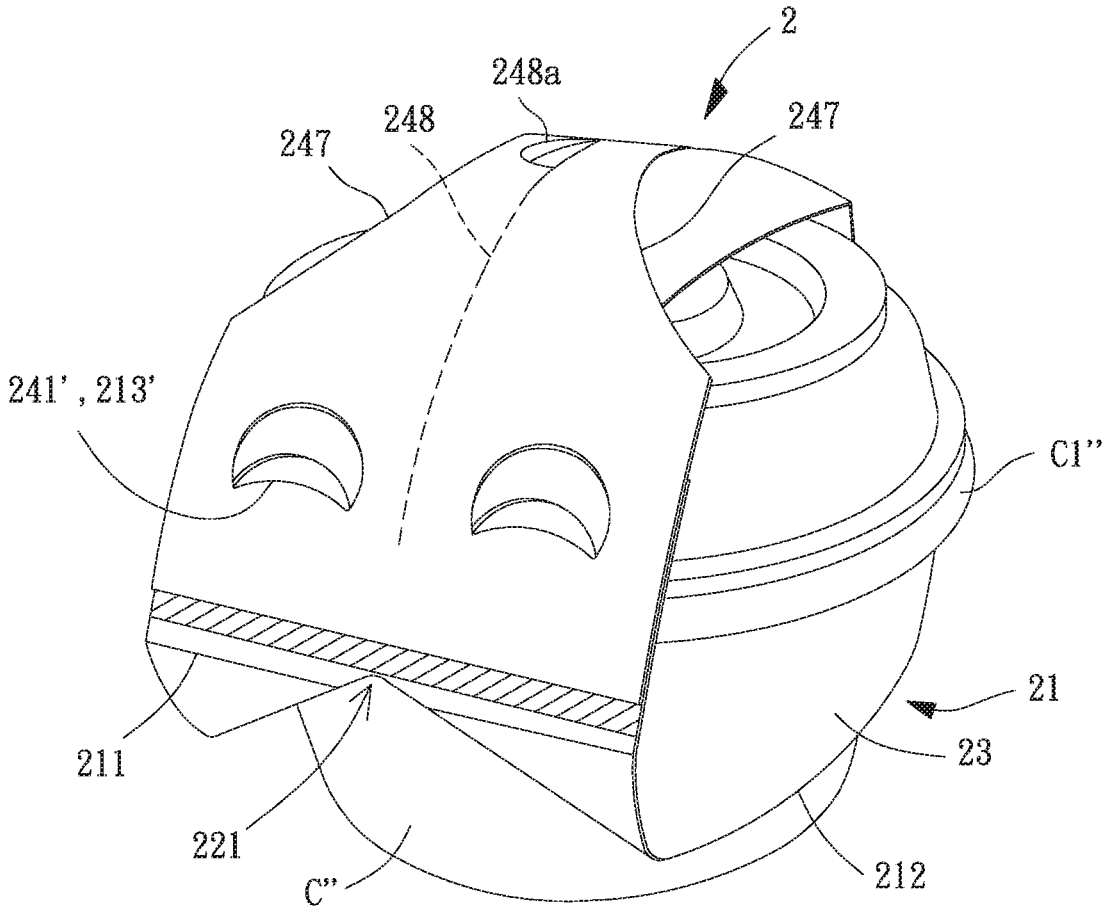

FIG. 24 shows a use of the eighth embodiment in connection with a bowl-shaped container, in which the eighth embodiment includes a first coupling portion and a second coupling portion in the form of buckling pieces arranged in the same direction according to the present invention.

Figure 25:
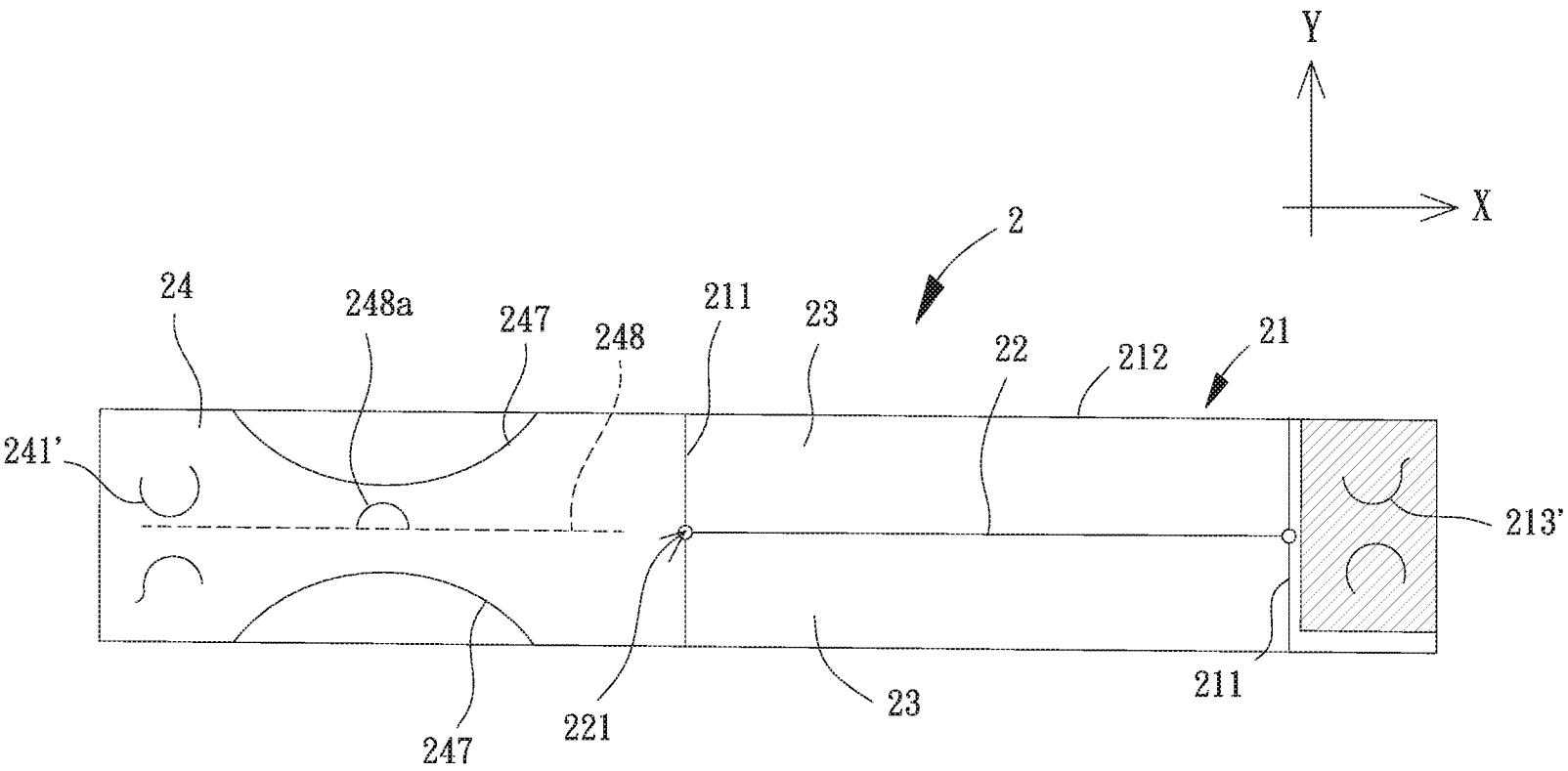

FIG. 25 a schematic view of an appearance of the eighth embodiment having a first coupling portion and a second coupling portion in the forms of buckling pieces arranged in different directions according to the present invention.

Figure 26:
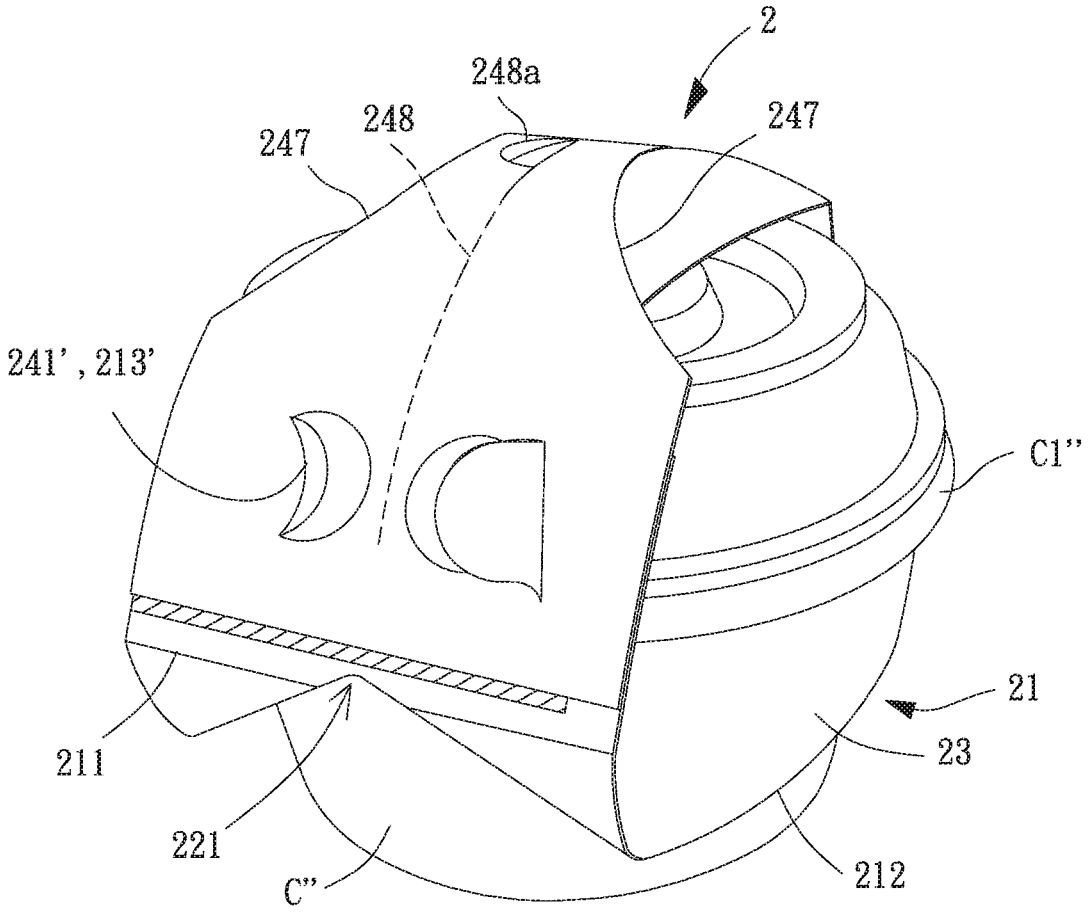

FIG. 26 shows a use of the eighth embodiment in connection with a bowl-shaped container, in which the eighth embodiment includes a first coupling portion and a second coupling portion in the forms of buckling pieces arranged in different directions according to the present invention.

THE INVENTION

1 lifting handle
11 base plate 111 end edge
112 lateral side
12 cut portion 121 extending portion
13 supporting portion 131 supporting edge
132 opening 133 crease
14 handling portion
15 reinforcing portion
2 lifting handle
21 base plate 211 end edge
212 lateral side 213 second coupling portion
213' second coupling portion
22 cut portion 221 guiding hole
222 pre-folded line
23 supporting portion 231 supporting edge
232 opening 233 crease
24 handling portion
24*a* first handling portion 24*b* second handling portion
24*c* third handling portion 24*d* fourth handling portion
241 first coupling portion 241' first coupling portion
242 through-hole
243 closure plate 243*a* penetration slit
244 engagement portion 245 insertion slit
246 inserting hole 247
248 stripping line 248*a* pressing plate
25 central line
X first direction Y second direction
C container C1 expanding portion

BEST EMBODIMENT FOR CARRYING OUT THE INVENTION

Best Implementation of the Invention

Figure 1:
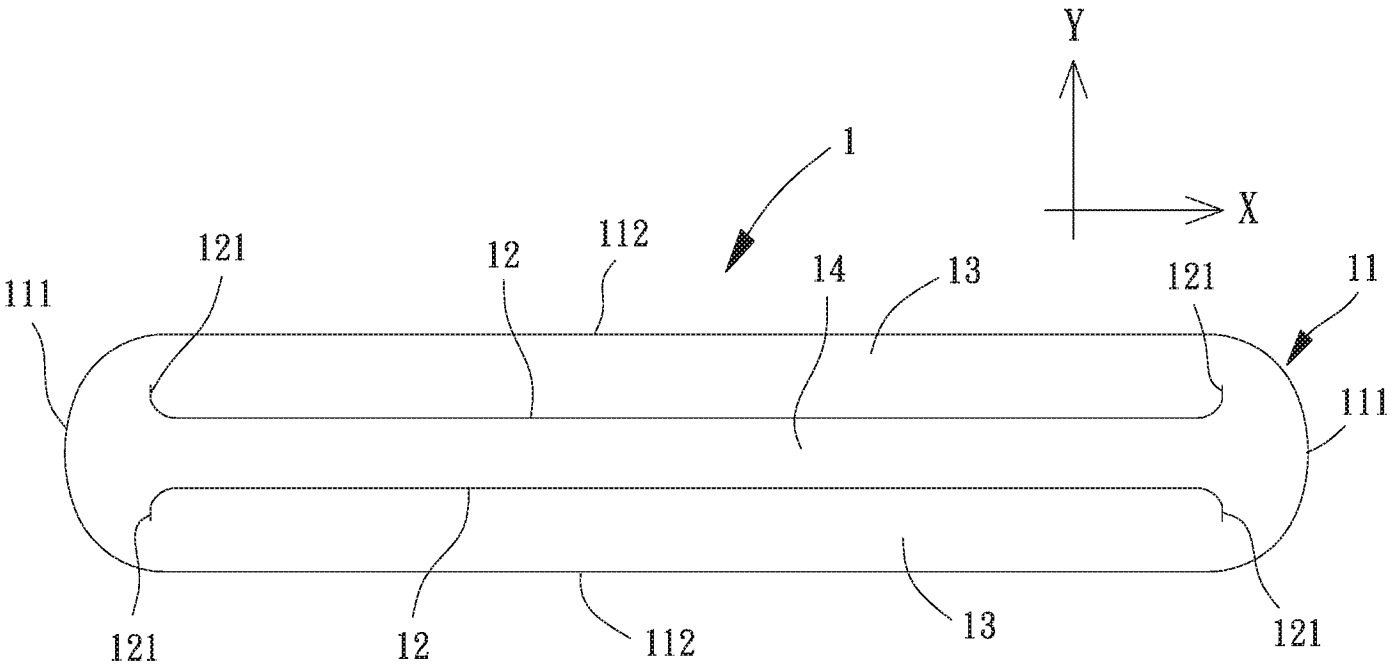
FIG. 1 is a schematic view of an appearance of a first embodiment according to the present invention.

Please refer to FIG. 1, which is a lifting handle 1 according to a first embodiment of the present invention. The lifting handle 1 has a first state. In the first state, the lifting handle 1 comprises a base plate 11. The base plate 11 can be made of paper material, plastic material or non-woven material, but it is not limited thereto in the present invention. The base plate 11 is in a sheet structure. The base plate 11 includes two end edges 111 and two lateral sides 112. The two end edges 111 are respectively formed at two ends of the base plate 11. Two ends of each lateral side 112 are respectively connected with the two end edges 111. Two cut portions 12 are arranged on the base plate 11. Each of the two cut portions 12 extends from a position adjacent to one of the end edges 111 of the base plate 11 to a position adjacent to the other end edge 111 of the base plate 11. The two cut portions 12 are spaced from the two lateral sides 112, respectively. In this embodiment and the following embodiments, the cut portion 12 is implemented as a cutting line. However, the person with ordinary knowledge in the art can easily appreciate that the cut portion 12 may also be a slit or a groove, so that the cut portion described throughout the application is not limited to the cutting line. Wherein the two cut portions 12 are cutting line extending through the base plate 11. The two cut portions 12 are arranged and spaced from each other. The two cut portions 12 can be parallel to each other.

More specifically, the base plate 11 has a first direction X and a second direction Y which are perpendicular to each other. The two end edges 111 are respectively formed at the two ends of the base plate 11 in the first direction X. The two lateral sides 112 are respectively formed on two sides of the base plate 11 in the second direction Y. The two cut portions 12 respectively extend in the first direction X. The two cut portions 12 are respectively spaced from the two lateral sides 112 in the second direction Y. Therefore, the lifting handle 1 may form a supporting portion 13 between each of the lateral side 112 and the adjacent cut portions 12, and form a handling portion 14 between the two cut portions 12.

In the first state, the base plate 11 is in a flat shape, so that the lifting handle 1 has the advantages of easy storage and small storage space.

Figure 2:
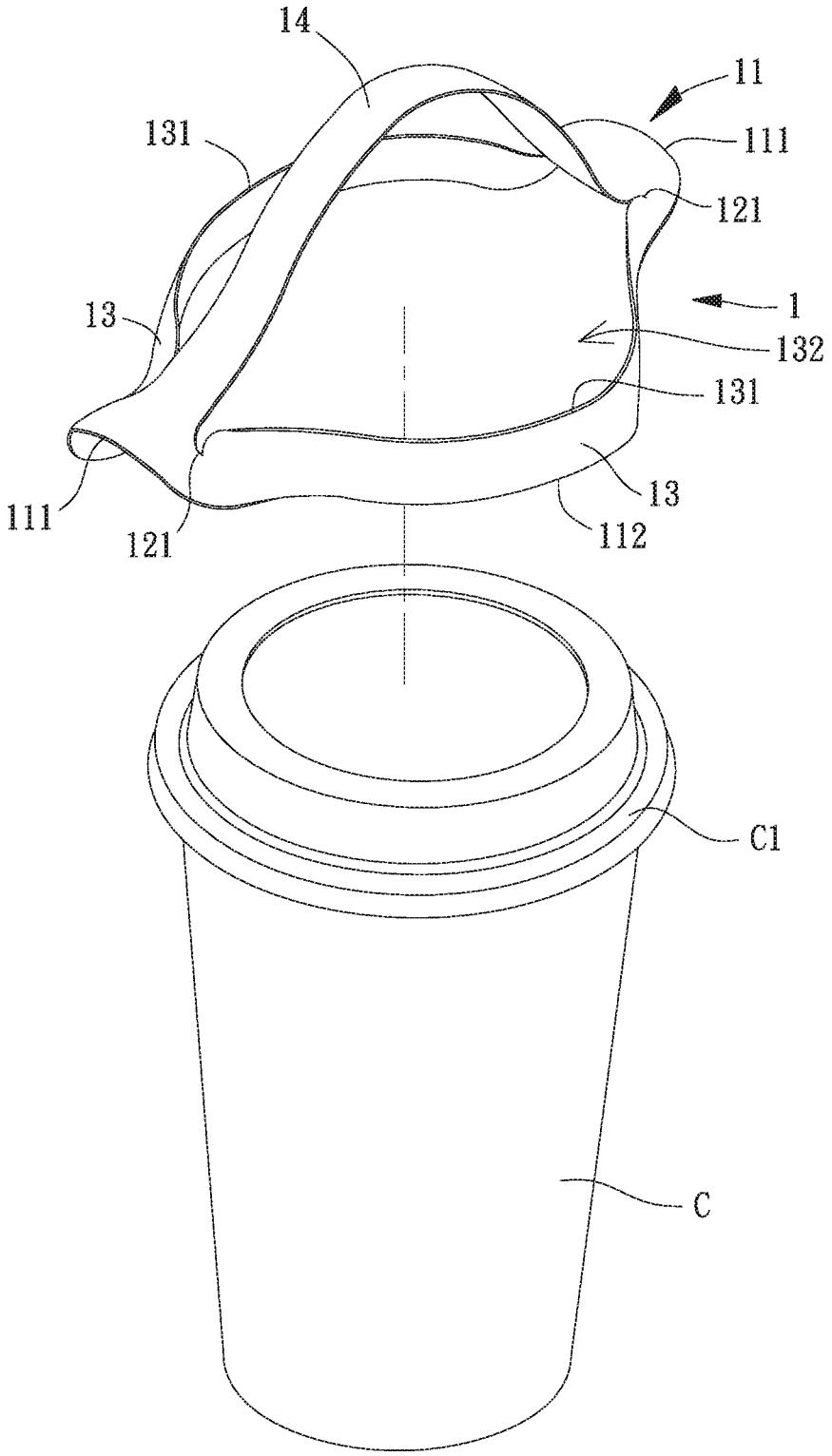
FIG. 2 is a schematic view showing the base plate changing from a first state to a second state according to the first embodiment of the invention.

With the above structure, please refer to FIG. 2. When the lifting handle 1 of the first embodiment of the invention is in use, the user can apply a force to change the lifting handle 1 from the first state to a second state. Specifically, the user can pull the two supporting portion 13 toward two sides in the second the direction Y and flip downwards in a longitudinal direction (according to the showing of the figures), so that the two supporting portions 13 are separated from the handling portion 14. One side of the supporting portion 13 facing the adjacent cut portion 12 is folded upwards (according to the showing of the figures) in the longitudinal direction to form a supporting edge 131, forming an opening 132 between the two supporting portions 13.

Furthermore, the user can pull the handling portion 14 upwards in the longitudinal direction (according to the showing of the figures) in the same time, forming a distance between the handling portion 14 and the two supporting portion 13 in the longitudinal direction.

Figure 3:
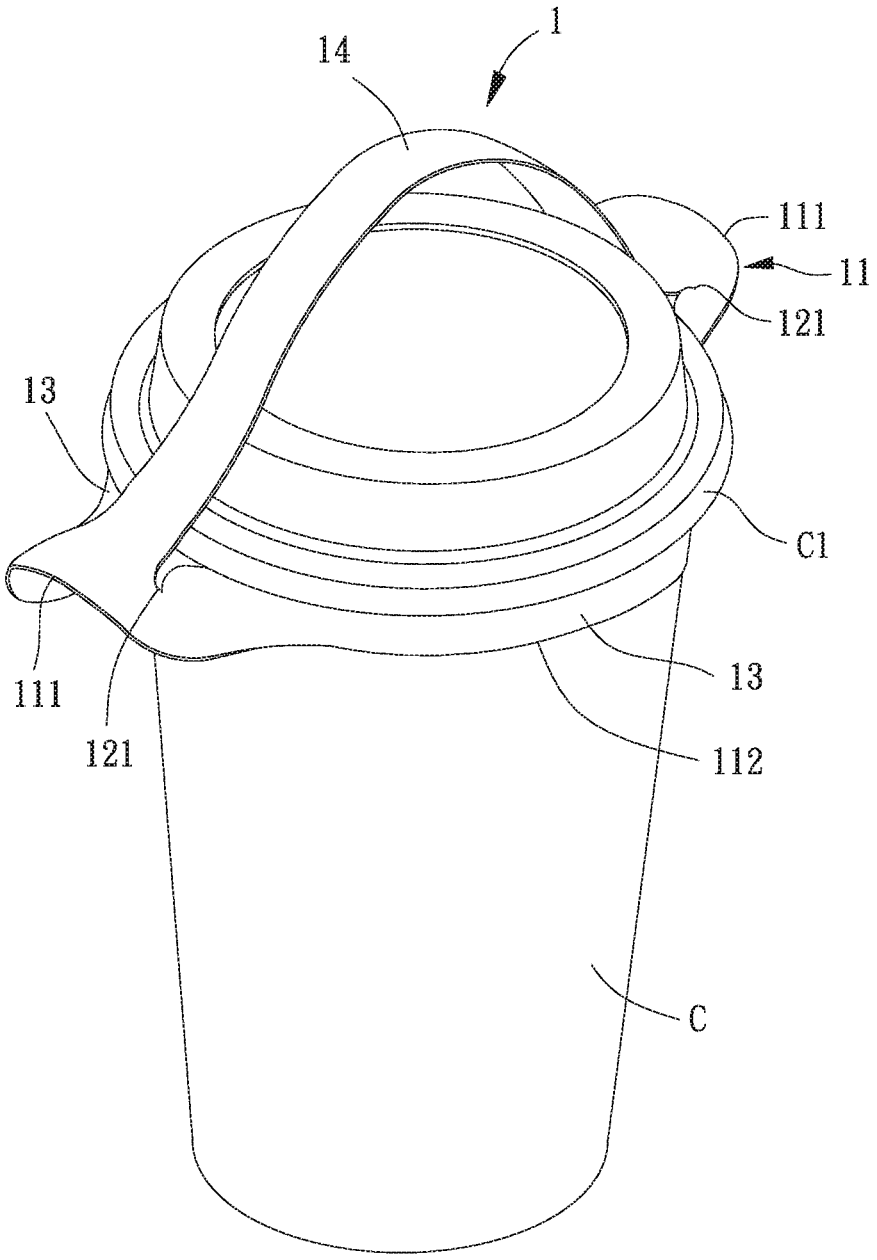
FIG. 3 shows a use of the first embodiment in connection with a container according to the present invention.

Please also refer to FIG. 3. When the lifting handle 1 changes to the second state under force, the lifting handle 1 can be configured to combine with a container C. Specifically, the container C includes an expanding portion C1 which may be a position of the container C with a larger outer diameter (i.e. the flange at the opening of the cup). The user applies a force to pull the two supporting portion 13 towards the two sides, making the inner diameter of the opening 132 larger than the outer diameter of the expanding portion C1. Thus, the expanding portion C1 can extend through the opening 132 from between the two supporting portions 13, and therefore is positioned between the two supporting portions 13 and the handling portion 14. When the expanding portion C1 passes through the opening 132, the user can stop applying force to the two supporting portions 13 to allow the inner diameter of the opening 132 to be smaller than the outer diameter of the expanding portion C1. In this way, the two supporting portions 13 can abut the outer surface of the container C while the supporting edges 131 of the two supporting portions 13 can respectively abut the expanding portion C1, thereby coupling the lifting handle 1 with the container C. Accordingly, the user can carry the container C via the lifting handle 1 by simply holding the handling portion 14 without touching the outer surface of the container C.

It is noted that since the content in the container C usually has a certain weight. Thus, when the user carries the container C via the lifting handle 1, the weight of the container C can produce a pulling force acting upon the handling portion 14. The two supporting portions 13 are formed on the two sides of the handling portion 14. Therefore, when the handling portion 14 bears the pulling force, the two supporting portions 13 will generate a binding force acting towards the opening 132. Accordingly, the supporting edge 131 which already abuts the expanding portion C1 of the container C can abut the expanding portion C1 more tightly. In other words, through the pulling force that acts upon the handling portion 14 by the container C as the user holds the handling portion 14, the binding force that acts toward the opening 132 can be generated on the two supporting portion 13. Thus, the two supporting portions 13 can be tightened inwards from two sides to stably position the container C on the supporting portion 13 of the lifting handle 1. Therefore, the user can conveniently hold the container C via the handling portion 14 without the disengagement of the container C from the lifting handle 1.

Please refer to FIGS. 1 and 3 again. In the first state, the lifting handle 1 can form an extending portion 121 at the two ends of the cut portion 12, respectively. In this embodiment, the extending portion 121 extends from the cut portion 12 towards the adjacent lateral side 112 in the first direction X, so that a distance between the extending portions 121 of the two cut portions 12 is gradually increased from the two cut portions 12 towards the adjacent end edge 111, and the extending portion 121 can be formed in an arc shape. Therefore, if the base plate 11 is made of a material that is not liable to generate a crease (compared with paper) such as plastic material, the lifting handle 1 can be changed to the second state through the formation of the extending portion 121 on the cut portion 12. After the lifting handle 1 is combined with the container C, the positions of the supporting portions 13 that are adjacent to the two end edges 111 of the base plate 11 can abut the container C as much as possible to improve the bonding strength between the lifting handle 1 and the container C.

More importantly, it is known that with the absence of the extending portion 121, the pulling force that the handling portion 14 bears forms a component force parallel to the first direction X at the two ends of the cut portion 12. It even causes that the cut portions 12 extend to the end edges 111 of the base plate 11 and thereby break the lifting handle. In the embodiment, by making the extending portion 121 extend towards the adjacent lateral side 112 and forming an angle of approximately 90 degree between the extending portion 121 and the cut portion 12, it can prevent the pulling force that the handling portion 14 bears from forming a component force parallel to the first direction X at the two ends of the cut portion 12 when the user holds the handling portion 14. In other words, through the arrangement of the extension portion 121 where the angle between the extension portion 121 and the cut portion 12 is approximately 90 degree, when the lifting handle 1 is held by the user, the force parallel to the first direction X at the two ends of the cut portion 12 is effectively reduced. Thus, breaking of the cut portion 12 at the two ends thereof can be avoided.

Figure 4:
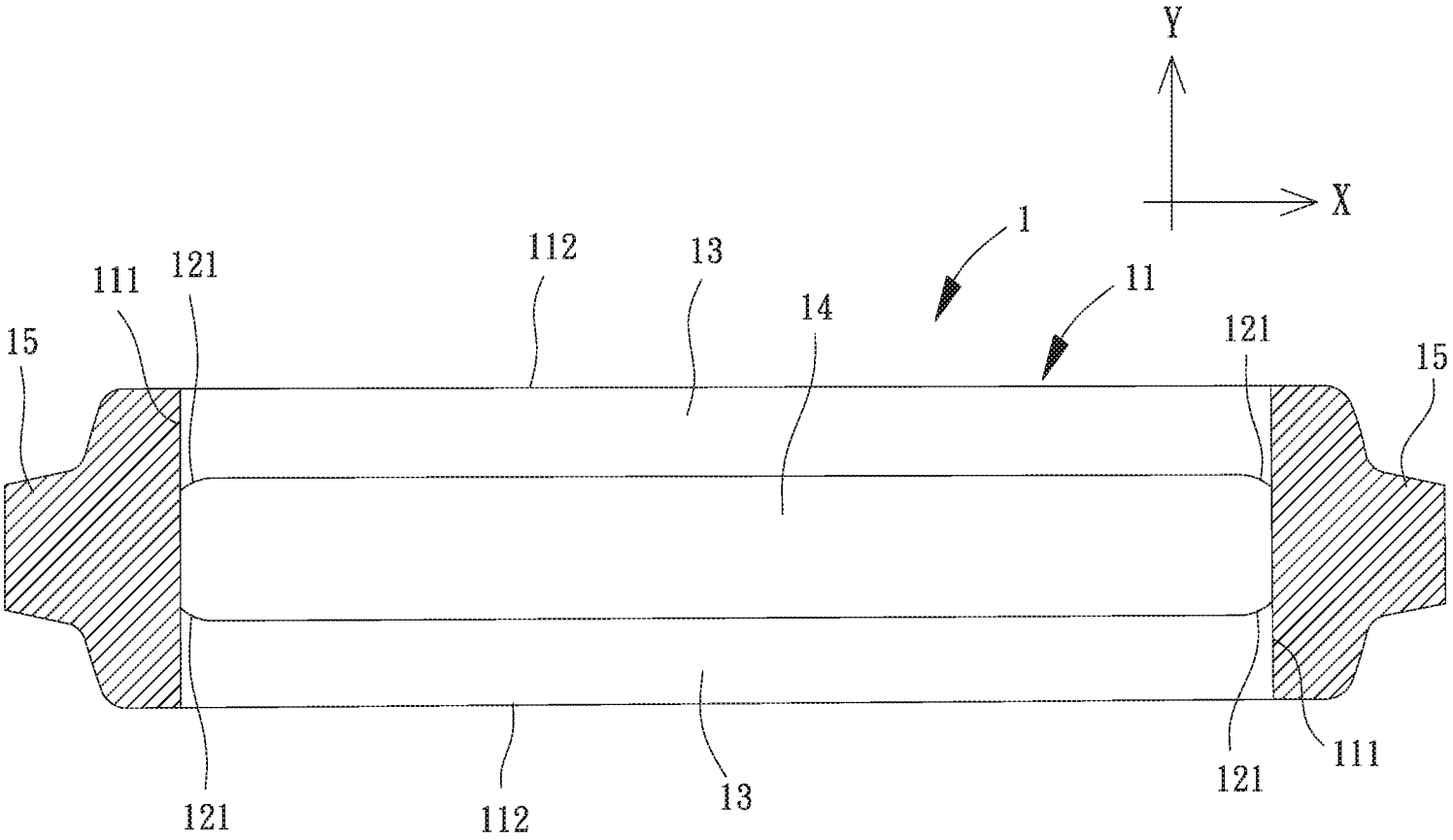
FIG. 4 is a schematic view of an appearance of a second embodiment according to the present invention.
Figure 5:
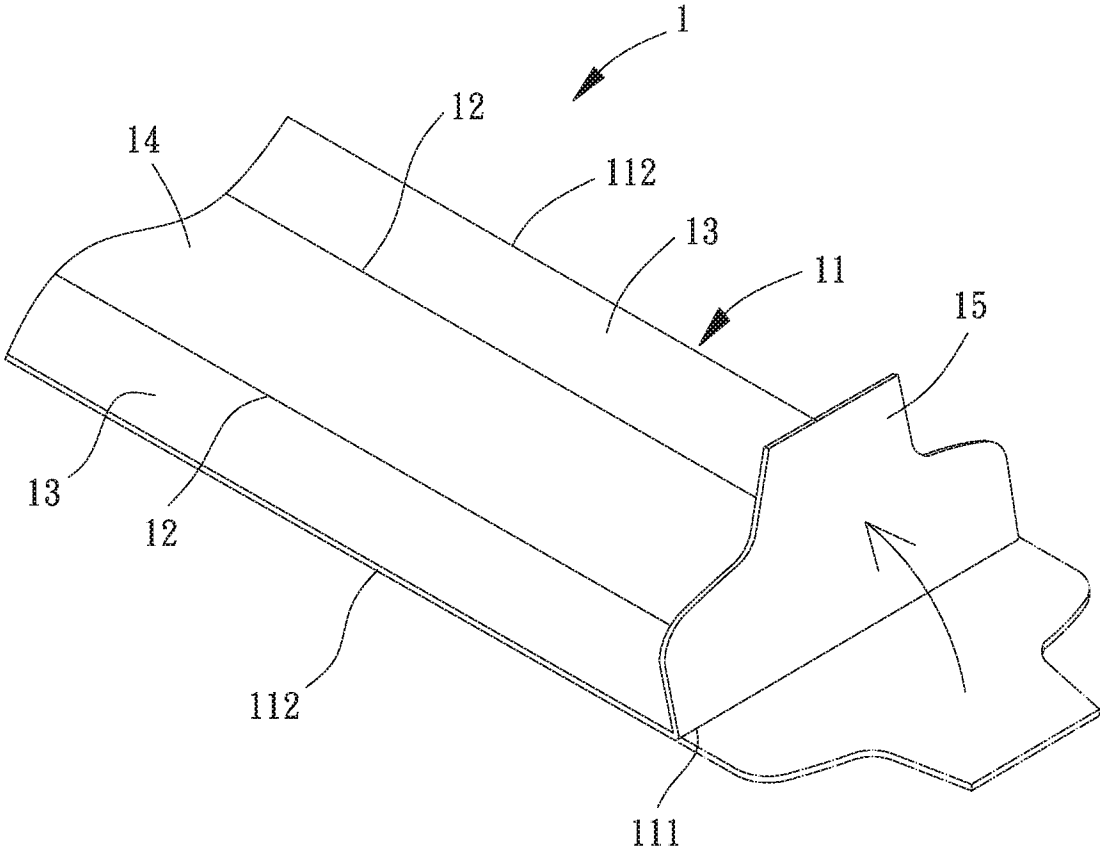
FIG. 5 shows the second embodiment coupled with a reinforcing portion according to the present invention.

Please refer to FIG. 4, which is a lifting handle 1 according to a second embodiment of the present invention and differs from the first embodiment in that: in the embodiment, a reinforcing portion 15 is respectively connected to the two end edges 111 of the base plate 11 of the lifting handle 1. The reinforcing portion 15 can be coupled with the two supporting portions 13 and the handling portion 14 at the same time. Specifically, the reinforcing portion 15 can be connected to the two supporting portions 13 and the handling portion 14 by adhesion beforehand. Alternately, please refer to FIG. 5, when it is desired to use the lifting handle 1, the user can fold the reinforcing portion 15 along the end edge 111 and couple the reinforcing portion 15 with the two supporting portions 15 and the handling portion 14 by adhesion. The present invention is not limited thereto.

Figure 6:
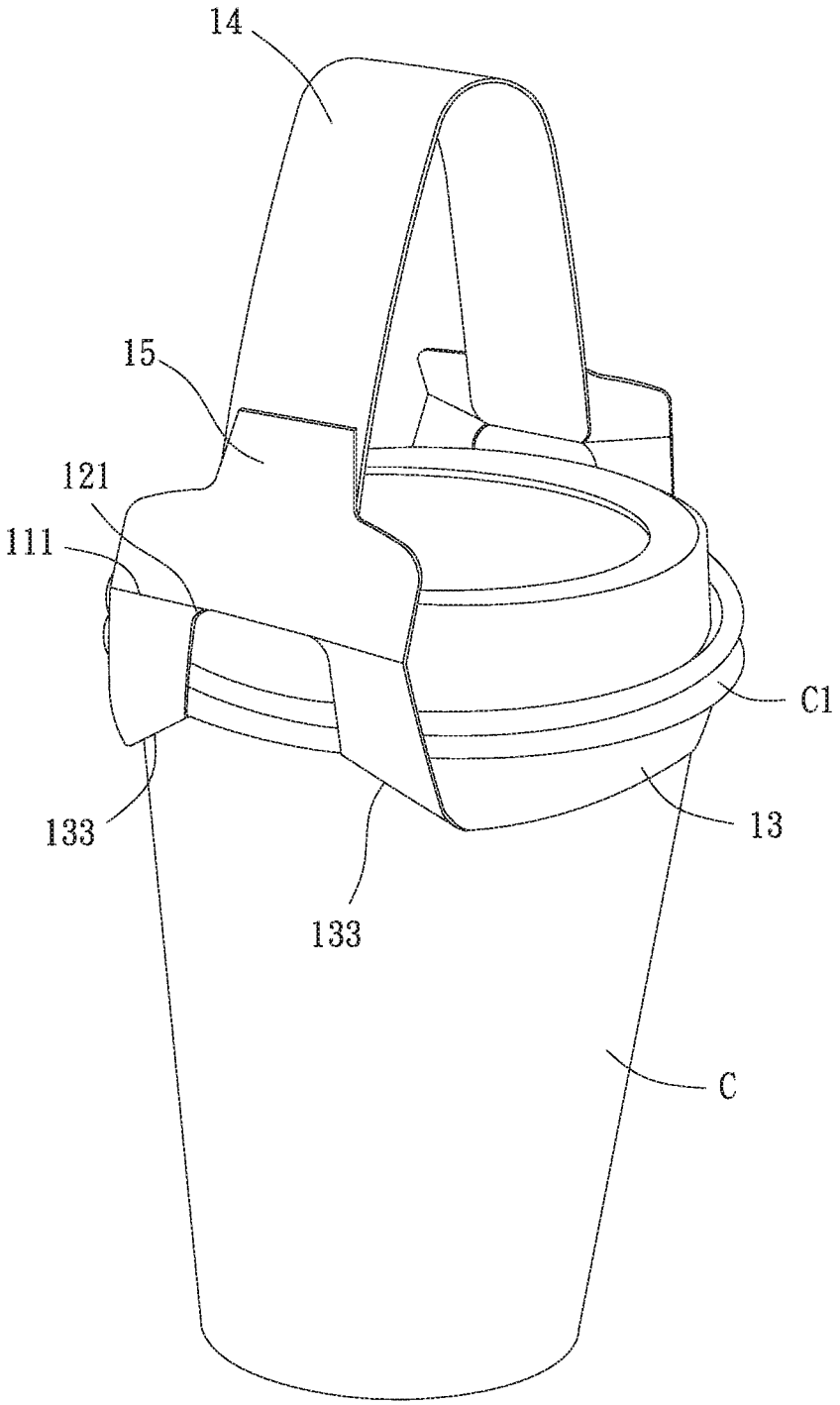
FIG. 6 shows a use of the second embodiment in connection with a container according to the present invention.

Please refer to FIG. 6, if the base plate is made of a material which can be broken apart under force such as paper, through the arrangement of the reinforcing portion 15 in the second embodiment that is coupled with the two supporting portions 13 and the handling portion 14 at the same time, the pulling force that the handling portion 14 bears is not liable to concentrate on the interface position between the two supporting portions 13 and the handling portion 14 when the user holds the lifting handle 1. Accordingly, the reinforcing portion 15 can effectively prevent the lifting handle 1 from breaking apart.

On the other hand, since the base plate 11 can be made of a material that is liable to generate creases such as paper in this embodiment, positions of the supporting portion 13 adjacent to the two end edges 111 of the base plate 11 can form a crease 133 respectively after the lifting handle 1 is changed to the second state and coupled with the container C. The creases 133 can be naturally formed or is a pre-folding line (not shown) of the supporting portion 13 arranged on the supporting portion 13 in advance. Accordingly, the portion of the supporting portion 13 between the two creases 133 can be firmly attached to the container C, and the portions of the supporting portion 13 outward of the two creases 133 are configured to connect to the handling portion 14.

It is noted that the lifting handle 1 can also form an extending portion 121 at the two ends of the cut portion 12, respectively. However, in this embodiment, the extending portion 121 extends from the cut portion 12 towards a center of the base plate 11 in the first direction X, such that the distance between the extending portions 121 of the two cut portions 12 is gradually reduced from the two cut portions 12 towards the adjacent end edges 111. The extending portion 121 can also be formed as an arc shape. Therefore, by forming the extending portion 121 on the cut portion 12, the supporting portions 13 are liable to naturally form the creases 133 under force after the lifting handle 1 is changed to the second state and coupled with the container C. In this embodiment, through the arrangements that the extending portion 121 extends towards the center of the base plate 11 and that the angle between the extending portion 121 and the cut portion 12 is approximately 90 degree, when the user holds the lifting handle 1, the force parallel to the first direction X at the two ends of the cut portion 12 is also effectively reduced. This can also prevent breaking of the cut portion 12 at the two ends thereof.

Figure 7:
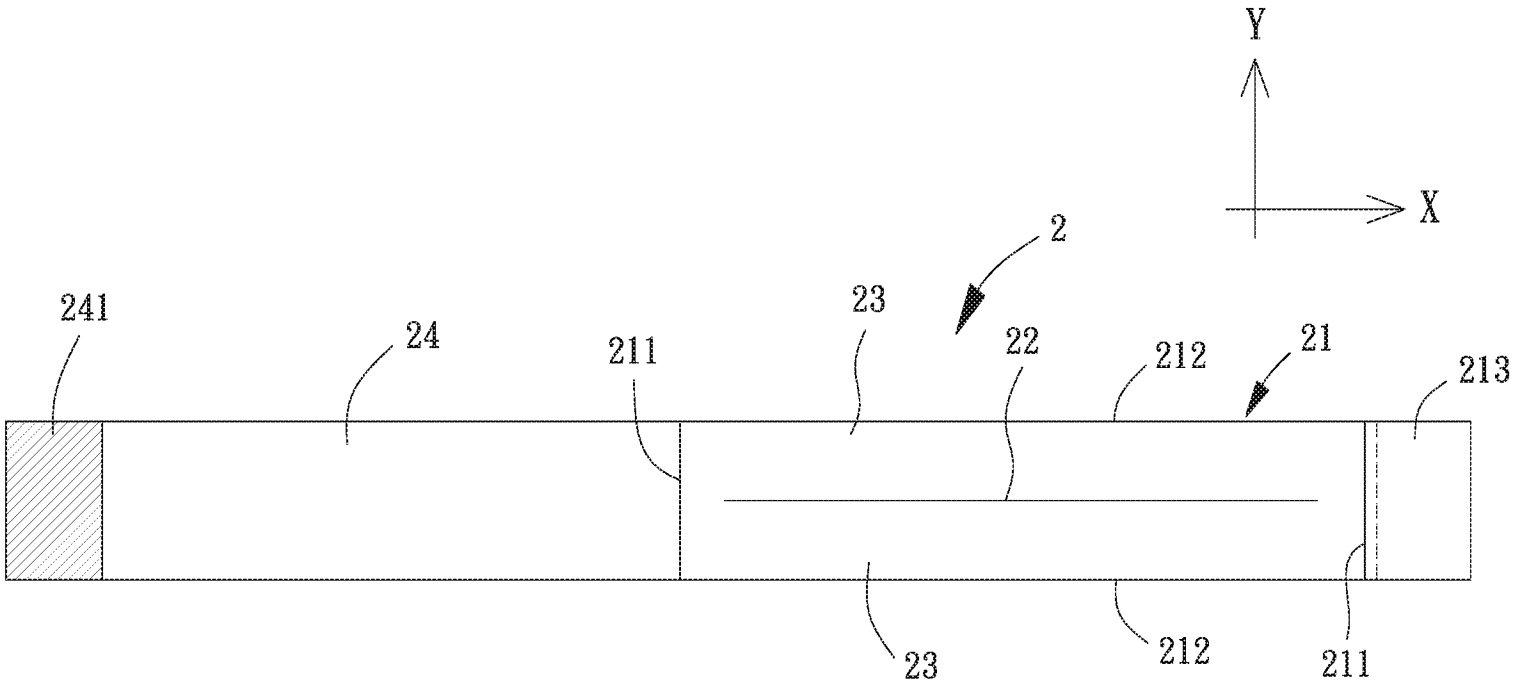
FIG. 7 is a schematic view of an appearance of a third embodiment according to the present invention.

Please refer to FIG. 7, which is a lifting handle 2 according to the third embodiment of the present invention. The lifting handle 1 also has a first state. In the first state, the lifting handle 2 also includes a base plate 21, which also includes two end edges 211 and two lateral sides 212. The two end edges 211 are respectively formed at two ends of the base plate 21. Two ends of each lateral side 212 are respectively connected to the two end edges 211, respectively. However, there is only one cut portion 22 on the base plate 21. The cut portion 22 extends from a position adjacent to one of the end edges 211 of the base plate 21 to a position adjacent to the other end edge 211 of the base plate 21, and the cut portion 22 is a cutting line extending through the base plate 21. Furthermore, one of the end edges 211 of the base plate 21 is coupled with a handling portion 24.

More specifically, the base plate 21 has a first direction X and a second direction Y which are perpendicular to each other. The two end edges 211 are respectively formed at two ends of the base plate 21 in the first direction X. The two lateral sides 212 are respectively formed on two sides of the base plate 21 in the second direction Y. The cut portion 22 extends in the first direction X. Thus, the lifting handle 2 can respectively form a supporting portion 23 on two sides of the cut portion 22 in the second direction Y. In the first state, the base plate 21 is also in a flat shape, such that the lifting handle 2 also has the advantages of easy storage and smaller storage space.

Figure 8:
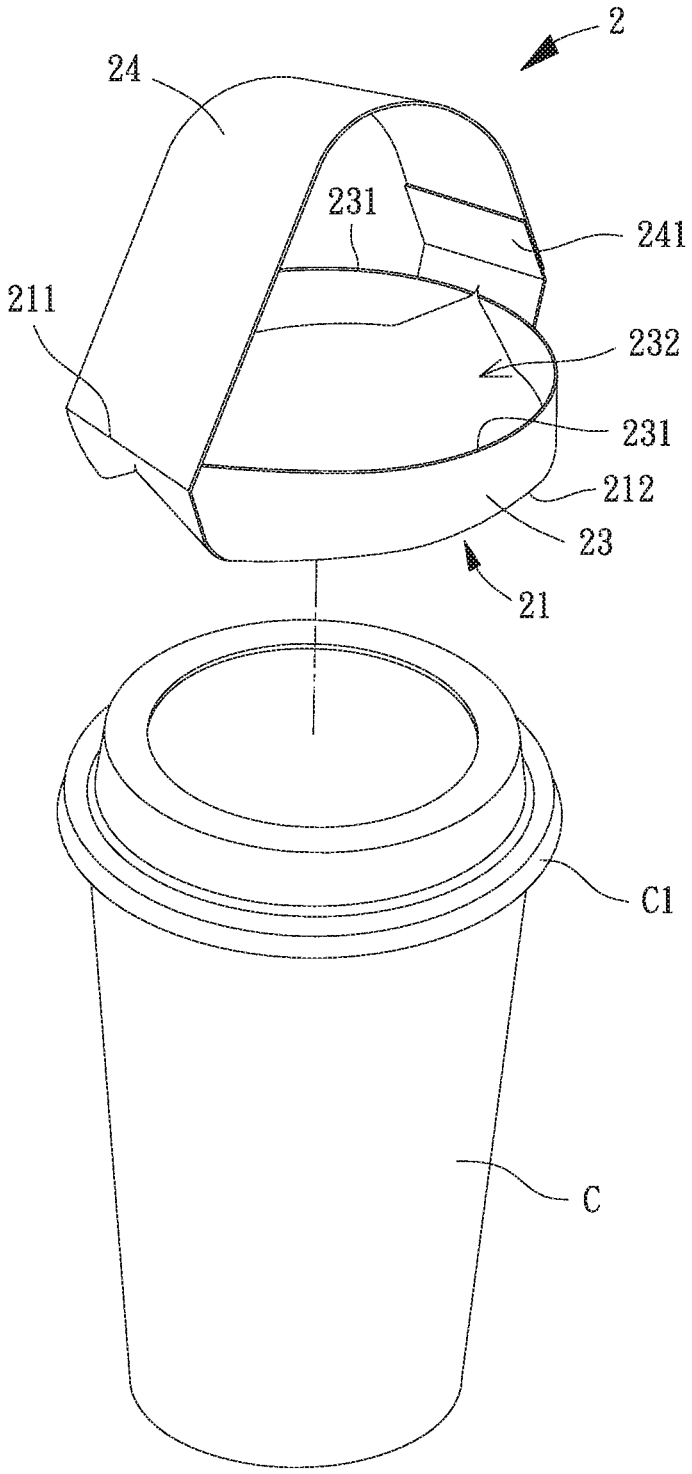
FIG. 8 is a schematic view showing the base plate changing from a first state to a second state according to the third embodiment according to the present invention.

With the above structure, referring to FIG. 8, the handling portion 24 that is connected to one of the end edges 211 of the base plate 21 can be connected to the other of the end edges 211 of the base plate 21, forming the base plate 21 as an annular shape. Wherein, the handling portion 24 can be coupled with the other of the end edges 211 of the base plate 21 simply by a conventional bonding structure such as a tape or a staple. Alternatively, in this embodiment, a first coupling portion 241 may be arranged at one end of the handling portion 24 away from the base plate 21, and the other end edge 211 of the base plate 21 is connected to a second coupling portion 213. The first coupling portion 241 or the second coupling portion 213 can be applied with an adhesive to permit the first and second coupling portions 241, 213 to be coupled with each other. Thus, the handling portion 24 is coupled with the other end edge 211 of the base plate 21, forming the base plate 11 as the annular structure.

When the lifting handle 2 of the third embodiment of the present invention is in use, similarly to the foregoing first and second embodiments, the user can apply a force to change the lifting handle 2 from the first state to a second state. Specifically, the user can also pull the two supporting portions 23 to the two sides in the second direction Y and flip downward in a longitudinal direction (according to the showing of the figures), forming an opening 232 between the two supporting portions 23. One side of the supporting portion 23 facing the cut portion 22 is bent upright in the longitudinal direction (according to the showing of the figures) and forms a supporting edge 231. In addition, since the base plate 21 is in an annular structure, the user can simultaneously pull the handling portion 24 upward (according to the showing of the figures) in the longitudinal direction to form a spacing between the handling portion 14 and the two supporting portions 13 in the longitudinal direction.

Referring also to FIG. 9, when the lifting handle 2 is changed to the second state under force, the lifting handle 2 can be coupled with a container C. Specifically, the container C also has an expanding portion C1. The user can apply a force to pull the two supporting portions 23 toward the two sides to make the inner diameter of the opening 232 larger than the outer diameter of the expanding portion C1. Thus, the expanding portion C1 may extend through the two supporting portions 23 via the opening 232 to be positioned between the two supporting portions 23 and the handling portion 24. After the expanding portion C1 extends through the opening 232, the user can stop applying a force to the two supporting portions 23 to make the inner diameter of the opening 232 smaller than the outer diameter of the expanding portion C1. Based on this, as shown in FIG. 9*a*, the two supporting portions 23 can abut the outer surface of the container C, and the supporting edge 231 of the two supporting portions 23 can respectively abut the expanding portion C1, permitting the lifting handle 2 to be coupled with the container C. Accordingly, similar to the foregoing first and second embodiments, the user can carry the container C via the lifting handle 2 by simply holding the handling portion 24 without touching the outer surface of the container C.

Please refer to FIG. 10, which is a lifting handle 2 of a fourth embodiment of the present invention and differs from the above third embodiment in that each of the two ends of the cut portion 22 is provided with a guiding hole 221. The guiding hole 221 is preferably a circular hole extending through the base plate 21. Referring to FIGS. 11 and 12, through the arrangement of the guiding hole 221, the guiding hole 221 is formed on the boundary between the two supporting portions 23 when the two supporting portions 23 are pulled apart at two sides. Thus, the guiding hole 221 can prevent the pulling force that the handling portion 14 bears from forming a stress concentration point due to the pulling force concentrating on the interface between the two supporting portions 23 when the user holds the container C via the lifting handle 1, thereby preventing the cut portion 22 from splitting toward the two ends.

In addition, the two ends of the cut portion 22 may also be respectively connected with pre-folded lines 222. Specifically, the two ends of the cut portion 22 may be respectively connected with two pre-folded lines 222. The two pre-folded lines 222 at either end of the cut portion 22 can be respectively connected to the guiding holes 221 arranged at the end, and the two pre-folded lines 222 respectively extend from the cut portion 12 toward the two lateral sides 212 in the first direction X. Therefore, when the lifting handle 2 is changed to the second state and is coupled with the container C, the pre-folded line 222 can assist the supporting portion 23 to form a crease 233 at a position adjacent to the two end edge 211 of the base plate 21.

Accordingly, the portion of the supporting portion 23 between the two creases 233 can closely abut the container C, and the portions of the supporting portion 23 outward of the two creases 233 are configured to connect to the handling portion 24.

Since the container C which is coupled with the lifting handles 1, 2, of the first, second, third and fourth embodiments of the present invention can contain high-temperature, room temperature or low-temperature contents, when the container C contains a low-temperature content, the outer surface of the container C is liable to attach with droplets due to the condensation of moisture in the air. Therefore, when the base plate 11, 21 is made of a material whose structural strength may be reduced due to the contact with the water such as paper, a surface of the base plate facing the container C may be provided with a film (not shown). The film may be formed on the surfaces of the base plates 11 by lamination, adhesion, or hot melt bonding to provide a water-moisture isolation function. This effectively prevents the reduction in the structural strength of the base plate 11, 21 resulting from the contact with the water, as it can be readily appreciated by the skilled persons in the art.

Please refer to FIG. 13, which is the lifting handle 2 of a fifth embodiment of the present invention and differs from the third embodiment in that the two end edges 211 of the base plate 21 are respectively coupled with a first handling portion 24*a* and a second handling portion 24*b*. The first handling portion 24*a* and the second handling portion 24*b* are respectively provided with a through-hole 242, and an edge of the through-hole 242 of the second handling portion 24*b* can be coupled with a closure plate 243. In this way, the first handling portion 24*a* and the second handling portion 24*b* can be aligned with each other for the user to hold, forming the base plate 21 as an annular structure.

In other words, referring to FIG. 14, when the lifting handle 2 of the fifth embodiment of the present invention is in use, the user can align the first handling portion 24*a* and the second handling portion 24*b* with each other, so that the through-holes 242 of the first and second handling portions 24*a*, 24*b* are aligned with each other. Thus, the user's hand can pass through the through-holes 242 of the first and second portions 24*a*, 24*b* respectively to hold the first and second handling portions 24*a*, 24*b* at the same time, forming the base plate 21 as an annular structure. In addition, a closure plate 243 that is coupled with the edge of the through-hole 242 of the second handling portion 24*b* may pass through the through-hole 242 of the first handling portion 24*a*, so that the first and second handling portions 24*a*, 24*b* can be fixed to each other.

Furthermore, referring to FIGS. 13 and 14, in this embodiment, an isolation portion 214 is arranged on the base plate 21. The isolation portion 214 is an elongated groove extending through the base plate 21 to divide the base plate 21 into two parts in the second direction Y, wherein two cut portions are respectively arranged on the portion of the base plate 21 located on both sides of the isolation portion 214. Thus, two supporting portions 23 are also respectively formed on the portion of the base plate 21 located on the two sides of the isolation portion 214 in the second direction Y, so that the two portions of the base plate 21 divided by the isolation portion 214 can be respectively coupled with a container C. In other words, the user can pull open the cut portions 22 arranged on both sides of the isolation portion 214, so that the two supporting portions 23 on the two sides of each of the cut portion 22 are pulled apart, forming an opening 232 on each side of the isolation portion 214. Thus, the expanding portions C1 of the two containers C can be passed through the openings 232 on both sides of the isolation portion 214 to couple the two containers C with the lifting handle 2 at the same time. Accordingly, the lifting handle 2 of the fifth embodiment of the present invention can be coupled with several containers C at the same time so that the user can carry several containers C simultaneously via the handling portion 24.

Referring to FIGS. 15 and 16, which is another implementation of the lifting handle 2 according to the fifth embodiment of the present invention. In comparison with the previous implementation, the length of the cut portion 22 arranged on the base plate 21 is shorter in the first direction X. Accordingly, as compared with the lifting handles 2 which are used to couple with the cup-shaped container C in the previous embodiments, in this embodiment, since the length of the cut portion 22 formed on the base plate 21 is shorter, the lifting handle 2 can be coupled with a bottle-shaped container C'. More specifically, it is known that the bottle-shaped container C' has a smaller diameter on the bottleneck, and the bottle-shaped container C' has an expanding portion C1' (i.e. the flange of the bottleneck). Therefore, by making the length of the cut portion 22 shorter in the first direction X, the bottleneck of the bottle-shaped container C' can be passed through the supporting portions 23 at the two sides of the cut portion 22. Afterwards, the two supporting portions 23 can still efficiently abut the expanding portion C1' of the bottle-shaped container C', such that the lifting handle 2 can be reliably coupled with the bottle-shaped container C'. It can be seen that the lengths of the cut portions 12, 22 arranged on the base plates 11, 21 of the lifting handles 1, 2 in the various embodiments of the present invention can be adjusted to fit the diameter of the container C to be coupled with, as it can be understood by those having ordinary skill in the art.

Referring to FIGS. 17 and 18, which is a lifting handle 2 of a sixth embodiment of the present invention and differs from the previous fifth embodiment in that the first handling portion 24*a* or the second handling portion 24*b* may further include an engaging portion 244 in addition to the through-hole 242. The engaging portion 244 may be configured to combine with various small containers such as coffee creamers, syrup boxes or sugar packs. In addition, two penetration slits 243*a* may be arranged on the closure plate 243 coupled with the edge of the through-hole 242 of the second handling portion 24*b*. The two penetration slits 243*a* respectively extend through the closure plate 243. Based on this, after the closure plate 243 passes through a through-hole 242 of the first handling portion 24*a*, a bar S formed by a stir stick or a straw can be respectively passed through the two penetration slits 243*a* by the user to couple the bar S with the closure plate 243. Accordingly, based on the arrangement of the engagement slit 244 and the penetration slit 243*a* on the lifting handle 2 in the sixth embodiment of the present invention, the components such as various types of small containers and a stir stick or a straw can be additionally fixed to the lifting handle 2 to improve the diversity in functions of the lifting handle 2. In addition, when the bar S passes through the two penetration slits 243*a*, respectively, the bar S can prevent the closure plate 243 from disengaging from the through-hole 242 of the first handling portion 24*a*. Therefore, even though the user temporarily places the lifting handle 2 alone, the first and second handling portions 24*a* and 24*b* can still be firmly coupled with each other, further improving the convenience in the use of the lifting handle 2.

Referring to FIG. 19, which is a lifting handle 2 of a seventh embodiment of the present invention. In the foregoing fifth and sixth embodiments, the implementation of the lifting handles 2 capable of simultaneously carrying two containers has been disclosed. In addition, by synchronously increasing the numbers of the isolation portions 214 and the cut portions 22 of the base plate 21, the number of the containers that can be coupled with the lifting handle 2 can be increased, as it can be easily understood by those skilled in the art. However, when the user wants to carry a larger number of containers (i.e. six) using the lifting handle 2, a single lifting handle 2 may hardly meet the demand. In light of this, the lifting handle 2 according to a seventh embodiment of the present invention includes two base plates 21. Two isolation portions 214 are arranged on each base plate 21 to divide the base plate 21 into three parts in the second direction Y. Each of the three parts is provided with a cut portion 22, and two edges of the base plate 21 are respectively provided with a third handling portion 24*c* and a fourth handling portion 24*d*. Wherein an insertion slit 245 extending in the second direction Y and through the third handling portion 24 is arranged on the third handling portion 24*c*. A through-hole 242 is arranged on the fourth handling portion 24*d*. The fourth handling portions 24*d* that are coupled with the two base plates 21 are connected to each other, and a central line 25 is formed on the connecting parts of the two fourth handling portions 24*d*.

The lifting handle 2 of the seventh embodiment also has a first state. In the first state, both the two base plates 21 are in a flat shape. Referring to FIG. 20 together, when the lifting handle 2 of the seventh embodiment is in use, the user can apply a force to change the lifting handle 2 from the first state to a second state. Specifically, the fourth handling portions 24*d* that are coupled with the two base plates 21 are folded downward along the central line 25 in a longitudinal direction (according to the showing of the figures) first, and the third handling portions 24*c* that are coupled with the base plate 21 are bent upward along the longitudinal direction (according to the showing of the figures). Based on this, the two fourth portions 24*d* may be respectively inserted into the insertion slits 245 of the two third handling portions 24*c*, forming the two base plates 21 of the lifting handle 2 of the seventh embodiment as an annular structure. Since a through-hole 242 is respectively arranged on the two fourth handling portions 24*d*, when the two fourth handling portions 24*d* are folded along the central line 25, the through-holes 242 of the two fourth handling portions 24*d* are aligned with each other. Thus, the user's hands can respectively pass through the through-hole 242 of the two fourth handling portions 24*d* to hold the two fourth handling portions 24*d* at the same time, forming the base plate 21 as an annular structure. The user can pull apart the supporting portions 23 on the two sides of each cut portion 22 of the base plates 21 toward the two sides so as to couple with a bottle-shaped container C'. Accordingly, the lifting handle 2 of the seventh embodiment can be coupled with six bottle-shaped containers C' in total. It can be known that through the combination of two base plates 21, the lifting handle 2 of the seventh embodiment of the present invention can be coupled with a larger number of containers, thereby providing a better function of the lifting handle 2.

In addition, since the lifting handle 2 of the seventh embodiment is configured to couple with a large number of containers, the total weight of the containers coupled with the lifting handle 2 is larger. An inserting hole 246 may be arranged on the two sides of the through-hole 242 of the fourth handling portion 24*d*, respectively. After the two fourth handling portions 24*d* are folded along the center line 25, the through-holes 246 of the two fourth handling portions 24*d* are aligned with each other. Accordingly, the user can pass a cord R through the inserting holes 246 of each of the fourth handling portions 24*d* to carry the lifting handle 2 via the cord R. Thus, the user can easily apply a force to carry the lifting handle 2. Alternatively, the user can use the cord R to hang the lifting handle 2 on other object so that the user does not have to carry the lifting handle for a long time. This makes the lifting handle 2 of the seventh embodiment more flexible in use.

Referring to FIGS. 21 and 22, which is a lifting handle 2 according to an eighth embodiment of the present invention and differs from the third embodiment in that two pre-folded lines 247 may be respectively arranged on two sides of the handling portion 14 in the second direction Y. The pre-folded line 247 may be formed in an arc shape. The two pre-folded lines 247 preferably form arc shapes having openings respectively facing toward the two sides of the handling portion 24. Therefore, as shown in FIG. 22*a*, the two supporting portions 23 can abut the outer surface of the container C, and the supporting edges 231 of the two supporting portions 23 can be respectively abut an expanding portion C1 of a bowl-shaped container C", permitting the lifting handle 2 to couple with the bowl-shaped container C". When the lifting handle 2 is used to couple with the bowl-shaped container C", the height of the bowl-shaped container C" is generally lower compared to the cup-shaped container C or the bottle-shaped container C'. In addition, the weight of the content in the container C" is usually larger, so that when the user carries the handling portion 24, the center of gravity of the bowl-shaped container C" tends to be unstable, and even the liquid in the bowl-shaped container C" may splash out. Therefore, through the arrangement of the arc-shaped pre-folded lines 247 having openings respectively facing the two sides of the handling portion 24 in the eighth embodiment, the user can press the pre-folded line 247 to fold it inwards from the outside, forming the handling portion 14 as a handle having a concave surface. Based on this, the user can rise the bowl-shaped container C" by pinching the concave surfaces formed on the two pre-folded lines 247, making it able to stably rise the bowl-shaped container C".

On the other hand, a stripping line 248 may be arranged between the two pre-folded lines 247 of the handling portion 14, and the stripping line 248 may be connected to a pressing plate 248*a*. When the user wants to take the content of the bowl-shaped container C", the pressing plate 248*a* can be pressed down. Thus, the position where the pressing plate 248*a* is pressed down can be used as a force of application for the user to apply a force to tear the handling portion 24 apart along the stripping line 248, so that the container 2 is peeled off the bowl-shaped container C" for the user to access the content of the bowl-shaped container C'.

Although in the aforementioned third and fourth embodiments, the handling portion 24 and the base plate 21 are bonded to each other through the first and second coupling portions 241 and 213 to couple the handling portion 24 to the other end edge 211 of the base plate 21 and to therefore form the base plate 11 as the annular structure. However, in some embodiments of the present invention, a first coupling portion 241' may be arranged at an end of the handling portion 24 away from the base plate 21, and the other end edge 211 of the base plate 21 is connected with a second coupling portion 213', wherein the first coupling portion 241' and the second coupling portion 213' are the corresponding engagement structures. More specifically, referring to FIGS. 22 and 23, the first coupling portion 241' may be in the form of two engagement pieces arranged in a pair in the same direction, and the second coupling portion 213' is also in the form of two engagement pieces arranged in a pair in the same direction. Thus, the first and the second coupling portions 241', 213' can be aligned with each other. The user only needs to press the engagement pieces formed by the first and second coupling portions 241', 213', the first and second coupling portions 241', 213' can be coupled with each other to form the base plate 11 as an annular structure. Alternatively, referring to FIGS. 25 and 26, the first and second coupling portions 241', 213' may be two engagement pieces arranged in pairs in different directions. Although manufacturing the engagement pieces that have different directions may increase the structural complexity of the lifting handle 2, however when the user only needs to press the engagement pieces formed by the first and second coupling portions 241', 213', the engagement pieces of the first and second coupling portions 241', 213' that are arranged in pairs in different directions will be able to improve the engagement strength between the first and second coupling portions 241', 213'.

Therefore, in the third, fourth and eighth embodiments of the present invention, the combination of the first coupling portions 241, 241' and the second coupling portions 213, 213' may be by ways of adhesion, engagement, or other various conventional methods. The present invention is not limited thereto.

Based on the above structure, the main features of the lifting handles 1, 2 of the first to eighth embodiments of the present invention are:

providing a base plate having at least one cut portion to permit the base plate to form two supporting portions and a handling portion. The lifting handle has a first state. The user can pull the two supporting portions apart toward two sides to change the lifting handle from the first state to a second state, forming an opening between the two supporting portions. Therefore, a container can extend through the opening, and an expanding portion of the container will be able to be positioned between the two supporting portions and the handling portion. The two supporting portions can respectively abut the expanding portion, permitting the lifting handle to couple with the container.

It can be known that the user can carry the container via the lifting handle by simply holding the handling portion without touching the outer surface of the container. Therefore, it can prevent the user from accidental burning caused by the high temperature received in the container while preventing, when the container contains low temperature content, the inconvenience resulting from the user's hand getting wet by the droplets of the condensation on the outer surface of the container. The lifting handles of various embodiments of the present invention does improve the convenience in carrying the container.

Moreover, when the lifting handles of the embodiments of the present invention are not yet coupled with a container, in the first state, the base plate is formed in a flat shape. Therefore, the lifting handle has the advantages such as easy storage and small storage space, and can achieve the advantage of reducing the cost of use.

In summary, the lifting handle of the present invention is provided to couple with a container, so that the user can carry the container via the lifting handle by simply holding the handling portion without touching the outer surface of the container. In addition, the base plate is in a flat shape before it is coupled with the container, surely achieving various advantages such as improving the convenience in carrying the container and reducing the cost of use.

What is claimed is:

1. A lifting handle comprising:

a base plate being made of paper and including two end edges and two lateral sides, wherein the two end edges are respectively formed at two ends of the base plate, and each of the two lateral sides has two ends respectively connected to the two end edges, the base plate has a first direction and a second direction, the base plate forms two cut portions spaced from each other, the two cut portions extend from a position adjacent to one of the end edges of the base plate to a position adjacent to another end edge of the base plate, and the two cut portions are respectively arranged and spaced from the two lateral sides in intervals, wherein the lifting handle has a first state and a second state, in the second state, each of positions adjacent to the two end edges of the base plate respectively forms a crease, two ends of each of the two cut portions respectively form an extending portion extending from the each of the two cut portions toward a center of the base plate in the first direction, making a distance between the extending portions of the two cut portions increase from the two cut portions toward the adjacent end edge.

2. The lifting handle as claimed in claim 1, characterized in that the first direction and the second direction are perpendicular to each other, the two end edges are respectively formed at the two ends of the base plate in the first direction, the two lateral sides are respectively formed on two sides of the base plate in the second direction, and the two cut portions respectively extend in the first direction and are respectively spaced from the two lateral sides in intervals.

3. The lifting handle as claimed in claim 2, characterized in that a supporting portion is formed between each of the two lateral sides and the cut portion adjacent to the lateral side, and a handling portion is formed between the two cut portions.

4. The lifting handle as claimed in claim 3, characterized in that the lifting handle has the first state, the base plate is in a flat form in the first state, the two supporting portions of the lifting handle can be pulled by two sides in the second direction to change the lifting handle from the first state to the second state, a supporting edge is formed at a side of the supporting portion facing the adjacent cut portion, and an opening is formed between the two supporting portions.

5. The lifting handle as claimed in claim 4, characterized in that the lifting handle is configured to couple with a container, the container includes an expanding portion located between the two supporting portions and the handling portion, the two supporting portions abut an outer surface of the container, and the supporting edges of the two supporting portions respectively abut the expanding portion.

6. The lifting handle as claimed in claim 3, characterized in that each of the two end edges of the base plate respectively connects to a reinforcing portion, and the reinforcing portion is coupled with the two supporting portions and the handling portion at the same time.

7. A lifting handle comprising:

a base plate including two end edges and two lateral sides, the two end edges are respectively formed at two ends of the base plate, and each of the two lateral sides has two ends respectively connected to the two end edges, the base plate has a first direction and a second direction, two cut portions are arranged on the base plate, the two cut portions extend from a position adjacent to one of the end edges of the base plate towards a position adjacent to the other end edge of the base plate, one of the end edges of the base plate is coupled to a handling portion, wherein an isolation portion is arranged on the base plate, the two cut portions are respectively arranged at two sides of the isolation portion of the base plate in the second direction, and two sides of the each of the two cut portions respectively form a supporting portion in the second direction.

8. The lifting handle as claimed in claim 7, characterized in that the first direction and the second direction are perpendicular to each other, the two end edges are respectively formed at the two ends of the base plate in the first direction, the two lateral sides are respectively formed at two sides of the base plate in the second direction, and the two cut portions extend in the first direction.

9. The lifting handle as claimed in claim 8, characterized in that the lifting handle has a first state, the base plate is in a flat form in the first state, the handling portion can be coupled with the other end edge of the base plate to form the base plate as an annular structure, and the two supporting portions of the lifting handle can be pulled apart toward two sides in the second direction to change the lifting handle from the first state to a second state, a supporting edge is formed at a side of the supporting portion facing the adjacent cut portion, and an opening is formed between the two supporting portions.

10. The lifting handle as claimed in claim 9, characterized in that the lifting handle is provided to couple with a container, the container include an expanding portion located between the two supporting portions and the handling portion, the two supporting portions abut an outer surface of the container, and the supporting edges of two supporting portions respectively abut the expanding portion.

11. The lifting handle as claimed in claim 10, characterized in further comprising another base plate, wherein two end edges of the each base plate respectively couple with a third handling portion and a fourth handling portion, an insertion slit is arranged on the third handling portion, the insertion slit extends in the second direction and extends through the third handling portion, a through-hole is arranged on the fourth handling portion, the fourth handling portions respectively coupled with the two base plates connect with each other, and a connecting part of the two fourth handling portions forms a central line, the two fourth handling portions can be folded along the central line, and the two fourth handling portions can be respectively inserted into the insertion slits of the two third handling portions, the through-holes of the two fourth handling portions are aligned with each other to jointly form the two base plates as the annular structure.

12. The lifting handle as claimed in claim 9, characterized in that a first coupling portion is arranged at one of the end edges of the handling portion away from the base plate, a second coupling portion is arranged at another end edge of the base plate, the first coupling portion and the second coupling portion can be combined with each other to couple the handling portion to the another end edge of the base plate, forming the base plate as an annular structure.

13. The lifting handle as claimed in claim 9, characterized in that the two ends of each of the two cut portions are respectively connected to two pre-folded lines, and the two pre-folded lines respectively extend from each of the two cut portions toward the two lateral sides in the first direction, in the second state, the pre-folded lines can permit the supporting portion to respectively form a crease at positions adjacent to the two end edges of the base plate.

14. The lifting handle as claimed in claim 9, characterized in that the two end edges of the base plate are respectively coupled with a first handling portion and a second handling portion, the first handling portion and the second handling portion are respectively provided with a through-hole, the first handling portion and the second handling portion are aligned with each other to form the base plate as the annular structure.

15. The lifting handle as claimed in claim 14, characterized in that an engaging portion is arranged on the first handling portion or the second handling portion, and an edge of the through-hole of the second handling portion is engaged with a closure plate, the closure plate is able to extend through the through-hole of the first handling portion, two slits are arranged on the closure plate, wherein the two slits respectively extend through the closure plate.

16. The lifting handle as claimed in claim 9, characterized in further comprising another base plate, wherein two end edges of the each base plate respectively couple with a third handling portion and a fourth handling portion, an insertion slit is arranged on the third handling portion, the insertion slit extends in the second direction and extends through the third handling portion, a through-hole is arranged on the fourth handling portion, the fourth handling portions respectively coupled with the two base plates connect with each other, and a connecting part of the two fourth handling portions forms a central line, the two fourth handling portions can be folded along the central line, and the two fourth handling portions can be respectively inserted into the insertion slits of the two third handling portions, the through-holes of the two fourth handling portions are aligned with each other to jointly form the two base plates as the annular structure.

17. The lifting handle as claimed in claim 8, characterized in that two pre-folded lines are respectively arranged on two sides of the handling portion in the second direction, the two pre-folded lines form arc shapes having openings respectively facing two sides of the handling portion, a stripping line is arranged between the two pre-folded lines of the handling portion.

18. The lifting handle as claimed in claim 7, characterized in that each of the two ends of each of the two cut portions is provided with a guiding hole, respectively.

* * * * *